US007545399B2

(12) United States Patent
Inoue et al.

(10) Patent No.: US 7,545,399 B2
(45) Date of Patent: Jun. 9, 2009

(54) LINE HEAD AND IMAGE FORMING APPARATUS USING THE SAME

(75) Inventors: Nozomu Inoue, Matsumoto (JP); Kiyoshi Tsujino, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 385 days.

(21) Appl. No.: 11/624,156

(22) Filed: Jan. 17, 2007

(65) Prior Publication Data

US 2007/0166077 A1 Jul. 19, 2007

(30) Foreign Application Priority Data

Jan. 19, 2006 (JP) ..... 2006-010649
Sep. 25, 2006 (JP) ..... 2006-258211

(51) Int. Cl.
*B41J 2/45* (2006.01)
*B41J 2/52* (2006.01)

(52) U.S. Cl. ..... 347/131; 347/254

(58) Field of Classification Search ..... 347/129, 347/130, 131, 248, 251, 254
See application file for complete search history.

(56) References Cited

U.S. PATENT DOCUMENTS 7,180,575 B2 * 2/2007 Kasumi et al. ..... 355/53
7,405,743 B2 * 7/2008 Toyama et al. ..... 347/131
2005/0007441 A1 1/2005 Hyuga
2008/0253808 A1 * 10/2008 Toyama et al. ..... 399/221

FOREIGN PATENT DOCUMENTS

| | | |
|---|---|---|
| JP | 60-154268 | 8/1985 |
| JP | 62085968 A | 4/1987 |
| JP | 03-004244 | 1/1991 |
| JP | 06-079118 | 3/1994 |
| JP | 2002-251023 | 9/2002 |
| JP | 2002-292922 | 10/2002 |
| JP | 2003025632 A | 1/2003 |
| JP | 2005028656 A | 2/2005 |

* cited by examiner

*Primary Examiner*—Huan H Tran
(74) *Attorney, Agent, or Firm*—Hogan & Hartson LLP

(57) ABSTRACT

A line head includes light-emitting element lines formed by arranging a plurality of light sources in a line shape in a main scanning direction. Each of the light sources is turned on/off corresponding to image data. Light beams emitted from the light sources pass through a lens array to form imaged spots on an exposed surface. The imaged spots generated by making the light beams emitted from the plurality of light sources imaged on the exposed surface are shifted by inches in the main scanning direction or a sub-scanning direction so as to overlap each other, thereby forming images. A gray-scale image of the images has a screen structure displayed on the basis of an area of dots or lines having a predetermined pitch. A diameter of each of the imaged spots formed on the exposed surface is set to be larger than a pitch between pixels and smaller than a pitch between lines or dots forming the screen. Gradation of an image is displayed by a combination of binary states of ON/OFF of each of the light sources.

11 Claims, 19 Drawing Sheets

LINE HEAD AND IMAGE FORMING APPARATUS USING THE SAME

CROSS REFERENCES TO RELATED APPLICATIONS

The present invention contains subject matters related to Japanese Patent Application No. 2006-10649 filed in the Japanese Patent Office on Jan. 19, 2006 and Japanese Patent Application No. 2006-25821 filed in the Japanese Patent Office on Sep. 25, 2006, the entire contents of which being incorporated herein by reference.

BACKGROUND

1. Technical Field

The present invention relates to a line head capable of easily realizing gray-scale display and an image forming apparatus using the same.

2. Related Art

In general, an electrophotographic toner image forming device includes a photoconductor serving as an image carrier having a photosensitive layer on an outer peripheral surface thereof, a charging unit that uniformly charges the outer peripheral surface of the photoconductor, an exposure unit that selectively exposes the outer peripheral surface uniformly charged by the charging unit so as to form an electrostatic latent image, and a developing unit that applies toner serving as a developer to the electrostatic latent image formed by the exposure unit so as to make a visible image (toner image).

A tandem-type image forming apparatus that forms a color image includes a plurality of (for example, four) toner image forming devices, which have been described above, disposed around an intermediate transfer belt. In this type of image forming apparatus, there is an intermediate transfer belt type in which toner images formed on the photoconductor by the single-color toner image forming devices are sequentially transferred onto the intermediate transfer belt and toner images corresponding to a plurality of colors (for example, yellow, cyan, magenta, and black) are superimposed on the intermediate transfer belt so as to obtain a color image on the intermediate transfer belt.

In the tandem-type image forming apparatus having the configuration described above, there is known that an LED or an organic EL element is used as a light-emitting element in a line head. In the line head having the configuration described above, exposure energy of each pixel is changed in a stepwise manner in order to improve a gray-scale level of an image that is formed. As a method of changing the exposure energy, a method of changing a lighting time, that is, a pulse width modulation (PWM) or a method of changing exposure power, that is, an intensity modulation (current modulation) has been used frequently.

As an example of gradation control, JP-A-06-079118 discloses a technique in which two pixels are arranged in the sub-scanning direction and are exposed at different timing so that an image is formed and multiple exposures are performed by superimposing pixels on a photoconductor. In the example, the gradation is displayed by performing combination of lighting of superimposed pixels. In addition, although not an example of the gradation control, an example of forming one pixel (output image) by using a plurality of sub-pixels is disclosed in JP-A-2002-292922. In a technique disclosed in JP-A-2002-292922, a pixel is divided into, for example, nine sub-pixels (3 sub-pixels in the main scanning direction×3 sub-pixels in the sub-scanning direction) for exposure. The plurality of sub-pixels are turned on at the same time regardless of positions thereof. A light source in JP-A-2002-292922 is disclosed as an 'electroluminescent element'. However, it is considered that an organic EL material is used for the light source because the electroluminescent element is weak to humidity, for example. Moreover, in examples of using a laser beam in a light source, which are disclosed in JP-A-2002-251023, JP-A-60-154268, and JP-A-03-004244, a technique of setting the size of a spot with respect to a pixel pitch is disclosed.

However, there has been a problem that a modulation circuit for the PWM or the current modulation, which is used to perform the gradation control, is required for each pixel, and accordingly, a driving circuit of each pixel becomes complicated and large. Particularly in recent years, even though such line head is used in an electrophotographic color page printer in many cases, a high capability of displaying photo or graphic and high reproducibility thereof are requested and a high-level gradation control is needed in the case of a color image, as compared with a monochrome image. The gradation control as above is performed in a digital manner. However, in order to perform the gradation control, an amount of information, that is, the number of bits larger than the number of gray-scale levels is needed. Accordingly, the size of a gradation control circuit tends to be large, which has caused a problem of cost increase.

Further, in order to improve gradation of an image to be formed, it is difficult to reduce the spot diameter (spot diameter at the time when a light beam emitted from a light source passes through a lens array and is then imaged on a surface of an image carrier) in correspondence with the density of pixels. Even if the spot diameter can be reduced, fluctuation of the spot size or the like of each pixel becomes large due to a difference among optical characteristics, such as focusing, of pixels in a lens array. As a result, there has been a problem that uniformity of an image may be damaged.

Furthermore, in the image forming apparatus disclosed in JP-A-06-079118, there has been a problem that, since light beams output from two light-emitting parts are completely superimposed on the same position, the resolution is not improve even if the number of pixels increases. In addition, FIG. 8 of JP-A-2002-292922 shows an example where three rows of light sources are arranged in a zigzag manner. Here, nine light-emitting parts form one 'light-emitting part group', and projection onto a photoconductor is made in the shape unchanged. For this reason, the gradation control has not been possible. In addition, objects of the techniques disclosed in JP-A-2002-251023, JP-A-60-154268, and JP-A-03-004244 are to improve the resolution of an image. Accordingly, in the case when a pixel pitch is small, the spot size should also be small corresponding to the pixel pitch. As a result, a control operation becomes troublesome.

SUMMARY

An advantage of some aspects of the invention is that it provides a line head capable of easily realizing gray-scale display and an image forming apparatus using the same.

According to an aspect of the invention, a line head includes light-emitting element lines formed by arranging a plurality of light sources in a line shape in a main scanning direction. Each of the light sources is turned on/off corresponding to image data. Light beams emitted from the light sources pass through a lens array to form imaged spots on an exposed surface. The imaged spots generated by making the light beams emitted from the plurality of light sources imaged on the exposed surface are shifted by inches in the main scanning direction or a sub-scanning direction so as to overlap each other, thereby forming images. A gray-scale image of the images has a screen structure displayed on the basis of an area of dots or lines having a predetermined pitch. A diameter of each of the imaged spots formed on the exposed surface is set to be larger than a pitch between pixels and smaller than a pitch between lines or dots forming the screen. Gradation of an image is displayed by a combination of binary states of ON/OFF of each of the light sources.

In the line head described above, preferably, the light-emitting element lines are arranged in the sub-scanning direction in the form of three or more rows of plural lines such that positions of the light-emitting element lines in the main scanning direction are different from each other.

Further, in the line head described above, preferably, the lens array is a refractive-index-distribution-type rod lens array having a plurality of rows of rod lenses arranged in the sub-scanning direction.

Furthermore, in the line head described above, preferably, a distance between two of the plurality of light-emitting element lines farthest apart from each other in the sub-scanning direction is smaller than a distance between centers of two of the plurality of rows of rod lenses of the rod lens array that are farthest apart from each other in the sub-scanning direction.

Furthermore, in the line head described above, preferably, gray-scale display of an image using the plurality of light sources is a process on a gray-scale screen on which gradation is displayed on the basis of a line width.

Furthermore, in the line head described above, preferably, each of the light sources is an organic EL element. According to such a configuration, since the diameter of a light-emitting portion may not be set to be small, it is possible to increase the optical power of a light-emitting portion.

Furthermore, in the line head described above, preferably, each of the light sources is formed on a single glass substrate.

Furthermore, in the line head described above, preferably, the light sources and thin film transistors (TFTs) for driving the light sources are formed on the single glass substrate.

According to another aspect of the invention, an image forming apparatus includes at least two or more image forming stations each having image forming units arranged therein, the image forming units including a charging unit provided on a periphery of an image carrier, the line head described above, a developing unit, and a transfer unit. Tandem-type image formation is performed by making a transfer medium pass through the stations.

In addition, according to still another aspect of the invention, an image forming apparatus includes: an image carrier configured to be able to carry an electrostatic latent image thereon; a rotary developing unit; and the line head described above. The rotary developing unit carries toners contained in a plurality of toner cartridges on a surface thereof, rotates in a predetermined rotation direction to sequentially transport different-colored toners to a position opposite to the image carrier, and applies a developing bias between the image carrier and the rotary developing unit in order to move the toners from the rotary developing unit to the image carrier, such that the electrostatic latent image is developed to form a toner image.

In the image forming apparatus, it is preferable to further include an intermediate transfer member.

As described above, in the line head and the image forming apparatus using the line head according to the aspects of the invention, the following effects are obtained. First, as for the resolution of an image that is formed or the diameter of an imaged spot formed on an exposed surface after light beams emitted from light sources pass through the lens array, the plurality of light sources are disposed in high density. Accordingly, it is possible to perform a satisfactory gradation control without providing a gradation control circuit for each pixel That is, regardless of binary dot ON/OFF control, the gradation display can be realized in an intensity modulation manner by largely overlapping adjacent exposure pixels. Second, since the image spot on a photoconductor is not almost changed even though the density of pixels corresponds to high resolution, precision requested to an optical system is alleviated, a manufacturing process becomes easy, and optical depth of focus increases. Third, in the aspect of the invention, since the diameter of the imaged spot formed by imaging light beams emitted from light-emitting portions is smaller than a pitch between lines or dots of a screen on which gradation display is performed, a sufficient gray-scale characteristic can be obtained. Fourth, as described above, in the aspect of the invention, the exposure pixels for binary control are disposed in high density as compared with the spot diameter. As a result, sufficiently gradation and smoothness of a profile can be obtained by simple control, without using an image forming system having a complicated configuration in order to realize high resolution.

BRIEF DESCRIPTION OF THE DRAWINGS

The invention will be described with reference to the accompanying drawings, wherein like numbers reference like elements.

DESCRIPTION OF EXEMPLARY EMBODIMENTS

In a line head used in a typical page printer, pixels are formed in a density of 600 dpi or 1200 dpi. In an embodiment of the invention, a satisfactory gradation control is realized by disposing a plurality of light sources in high density, as compared with the related art in which a gradation control circuit is provided at each pixel so as to perform the gradation control. As an example, the density of pixels is set to 2400 dpi or 4800 dpi.

Figure 2A:
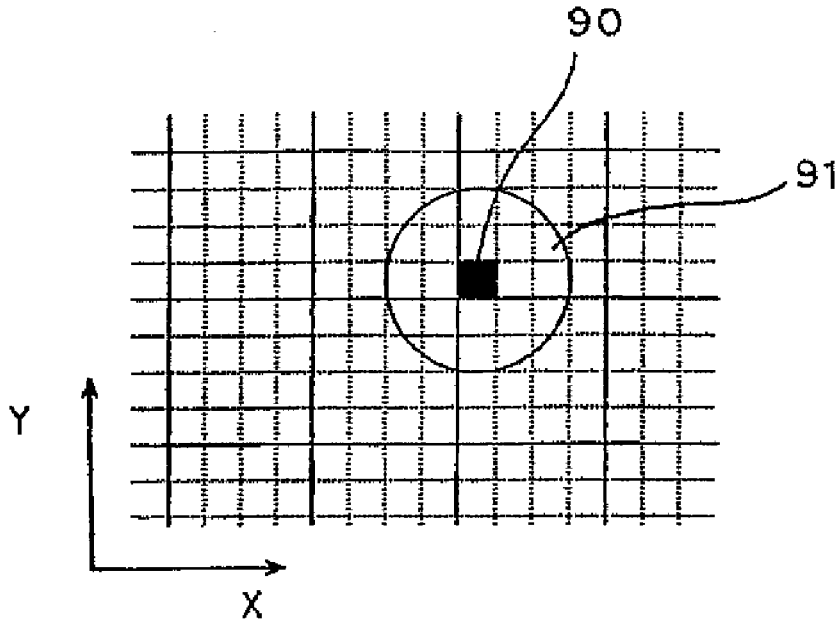
FIGS. 2A and 2B are explanatory views illustrating an embodiment of the invention.
Figure 2B:
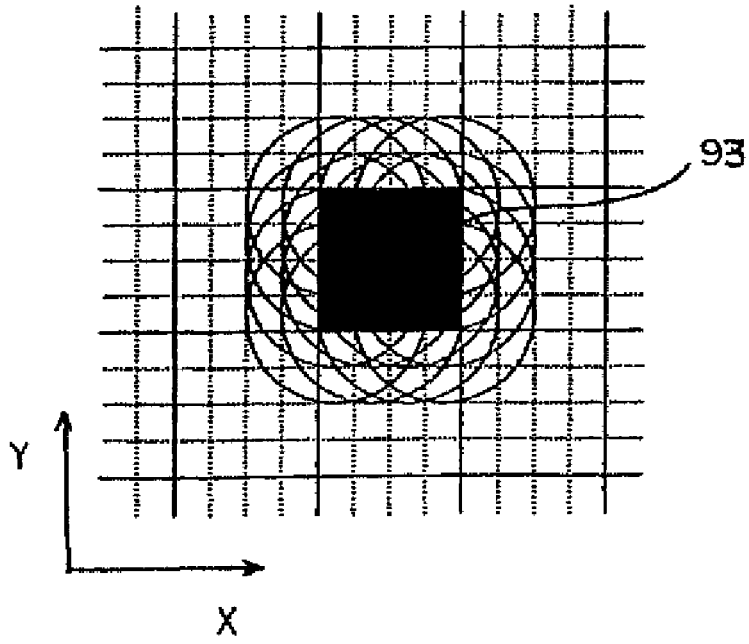

FIGS. 2A and 2B are explanatory views schematically illustrating a basic technique of the invention. In examples shown in FIGS. 2A and 2B, the density of pixels is set to 2400 dpi. In FIG. 2A, reference numeral 90 denotes a pixel of a light source and reference numeral 91 denotes a spot diameter when a light beam output from the light source passes through a lens array to be then imaged on an exposed surface, such as an image carrier. In the specification, a diameter of an imaged spot formed on the exposed surface will hereinafter be referred to simply as a spot diameter, and the spot diameter is defined as a width corresponding to the intensity of $1/e^2$ of a peak value of a light intensity profile on the exposed surface, which will be described later with reference to FIG. 5. In addition, an X-direction indicates a main scanning direction and a Y direction indicates a sub-scanning direction. In this example, the spot diameter 91 is 50 μm, and the size of a light source that forms a pixel (exposure pixel) 90 is 20 μm.

As described above, since the spot diameter of one exposure pixel is large but exposure energy is low, an image cannot be formed with a single exposure pixel, and accordingly, several tens of exposure pixels are exposed to be first formed as an actual image. That is, the spot diameter is formed to be several times as large as a pixel pitch. As described above, it is difficult to reduce the size of a spot, and there is little effect if a photoconductor, a toner, and a developing system thereof cannot correspond to the size, which will be described later. In the case of an organic EL element, if an area of a light-emitting portion is reduced to increase the spot diameter, the power for forming an image runs short. In addition, since the density of gray-scale screen used to display a gray-scale image is in a range of 100 to 300 LPI and a halftone dot or a full line is formed by a plurality of exposure pixels not by a single exposure pixel, it is not necessary to make the size of each pixel small.

In the embodiment of the invention, as shown in FIG. 2B, a plurality of exposure pixels are overlapped on an image carrier in the main scanning and sub-scanning directions so as to be exposed. In this example, four pixels in the main scanning direction and four pixels in the sub-scanning direction, that is, sixteen (4×4=16) pixels are overlapped to form an output image 93. That is, an imaged spot formed on the exposed surface shifts by inches in the main scanning direction or sub-scanning direction so as to overlap to each other, thereby forming an image. In the example described above, since sixteen exposure pixels in the resolution of 2400 dpi can form one pixel in the resolution of 600 dpi in the related art, an energy of one exposure pixel is reduced to 1/16 of that in the related art. Therefore, as will be described later, the invention is effective particularly to a line head that uses as a light source an organic EL in which it is difficult to secure an amount of light per unit area. This is due to synergetic effect that an area of a light-emitting portion can be made large and energy of an exposure pixel is reduced.

Here, since each pixel 90 that forms the output image 93 has a size different from an image obtained as the output image 93, each pixel 90 is defined as an exposure image in the present embodiment. In an example shown in FIG. 2B, an image is displayed in the image intensity corresponding to 16 (4×4=16) gray-scale levels. That is, a gradation control on the sixteen gray-scale levels becomes possible by turning on/off each of the sixteen light sources.

Therefore, since a complicated circuit configuration for modulation control, which is used for gradation control, is not needed on a line head, the gradation control can be made only with ON/OFF control of a light-emitting element. As a result, the gradation control can be sufficiently made by mounting a switching element, such as a TFT (thin film transistor for driving a light source), used to make ON/OFF control of a light-emitting element on the same glass substrate as a light source, which allows the configuration of a control unit mounted in a line head to be simple.

Figure 1A:
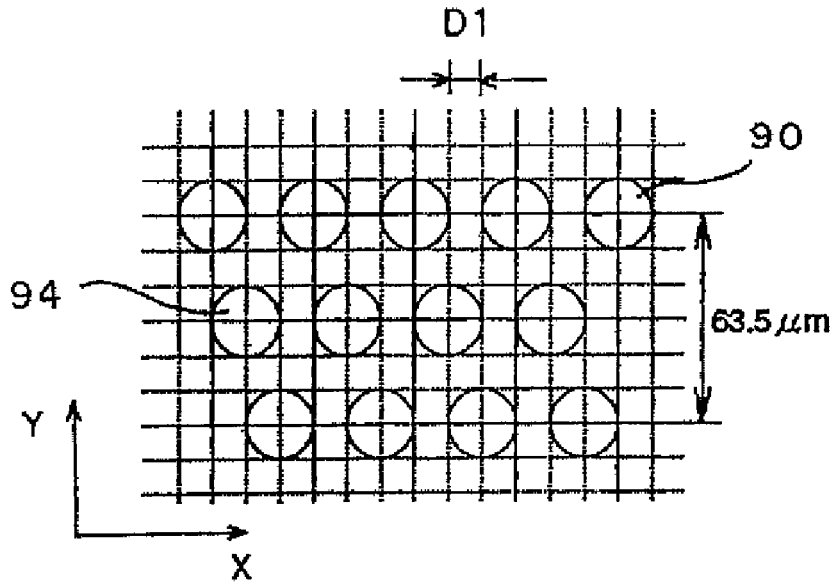
FIGS. 1A and 1B are explanatory views illustrating an embodiment of the invention.
Figure 1B:
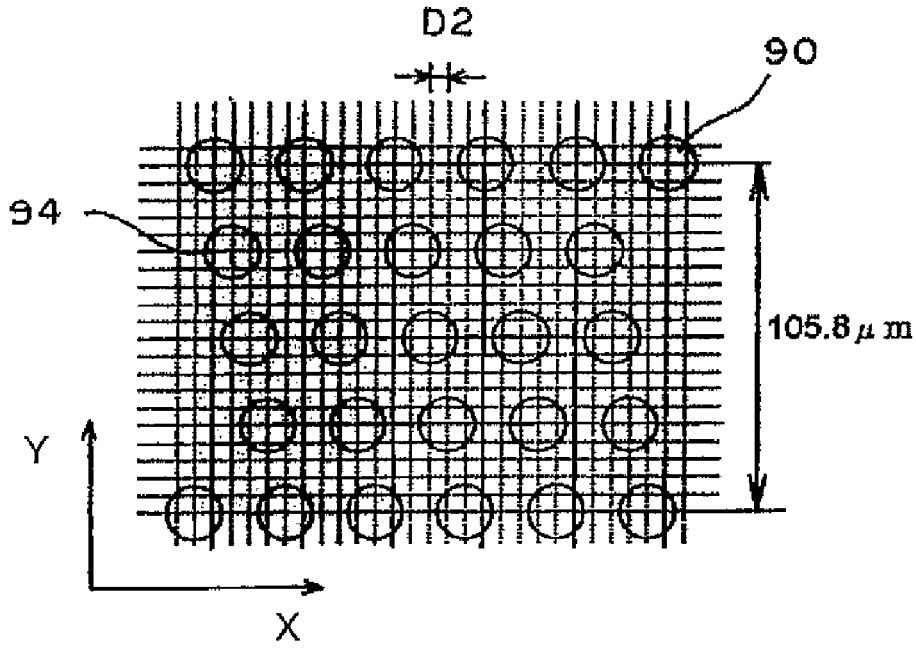

FIGS. 1A and 1B are explanatory views illustrating examples of a pixel arrangement in the embodiment of the invention. FIG. 1A illustrates an example in which light emitting portions having diameters of 20 μm are arranged in 2400 dpi. In this example, the spot diameter is 60 μm and three rows of light-emitting element lines 94 are provided in the sub-scanning direction, the plurality of exposure pixels 90 arranged in the main-scanning direction being provided on each of the light-emitting element lines 94. A pixel pitch is about 10.6 μm (25.4/2400). A distance between central lines of the light-emitting element lines 94 located at both ends in the sub-scanning direction is 63.5 μm which is about six times the pixel pitch. Accordingly, a ratio between the spot diameter and the pixel pitch is about 5.7 (60/10.6), and thus the spot diameter is set to be larger than the pixel pitch.

FIG. 1B illustrates an example in which light emitting portions having diameters of 15 μm are arranged in 4800 dpi. In this example, the spot diameter is 55 μm and five rows of light-emitting element lines are formed in the sub-scanning direction. In this case, the pixel pitch is about 5.3 μm (25.4/4800). A distance between central lines of the light-emitting element lines 94 located at both ends in the sub-scanning direction is 105.8 μm which is about twenty times the pixel pitch. In this example, a ratio between the spot diameter and the pixel pitch is about 10.4 (55/5.3), and thus the spot diameter is set to be even larger than the pixel pitch as compared with the example shown in FIG. 1A. As described above, in FIGS. 1A and 1B, a plurality of light-emitting element lines, which are provided at three or more rows in the sub-scanning direction, are arranged such that the positions of the light-emitting element lines in the main scanning direction are different from one another. Therefore, overlapping of imaged spots in the main scanning direction can be easily performed.

Gradation of an original image is displayed on the basis of the number of exposure pixels that are turned on. That is, each exposure pixel is controlled in a binary manner. For example, in the case of 2400 dpi, sixteen gray-scale levels can be obtained because 16 pixels correspond to one pixel in the case of 600 dpi in the related art, and in the case of 4800 dpi, sufficient gray-scale levels can be obtained because 64 pixels correspond to one pixel in the case of 600 dpi in the related art. Accordingly, sufficient gradation can be obtained. Moreover, since the spot size is much larger than the pitch between exposure pixels, deformation of shape of pixels occurring due to change of the number of turned-on exposure pixels when performing gray-scale recording does not occur easily.

Figure 3A:
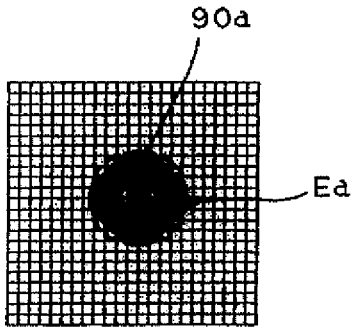
FIGS. 3A to 3D are explanatory views illustrating an example of the related art.

Next, it will be described why the gradation control in the case when the spot diameter is set to be larger than the pixel pitch in the embodiment of the invention is more reliable than that in the related art. FIGS. 3A to 3D are explanatory views illustrating change of surface potential distribution as the number of exposure pixels that are turned on increases in the related art. In this example, the density of exposure pixels is set to 2400 dpi and the spot diameter is 20 μm or less. In FIG. 3A, electric potential distribution Ea when turning on a single exposure pixel 90*a* is formed almost in a circle. Hereinafter, a black dot in the drawings indicates a central position of an exposure pixel.

Figure 3B:
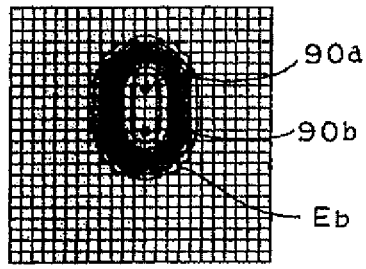

In FIG. 3B, there is shown electric potential distribution Eb in a case where an additional exposure pixel 90*b* is provided in the sub-scanning direction so as to be adjacent to the exposure pixel 90*a* described in the FIG. 3A and the exposure pixel 90*a* and the exposure pixel 90*b* are turned on at the same time. In this case, the electric potential distribution Eb has an elliptical shape which is longer in the sub-scanning direction.

Figure 3C:
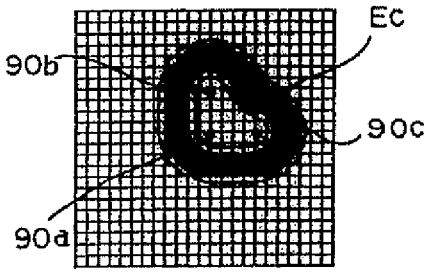

In FIG. 3C, there is shown electric potential distribution Ec in a case where an exposure pixel 90*c* is provided so as to be adjacent to the exposure pixel 90*a* in the main scanning direction in the configuration shown in FIG. 3B and the three exposure pixels of the exposure pixel 90*a*, the exposure pixel 90*b*, and the exposure pixel 90*c* are turned on at the same time. In this case, the electric potential distribution Ec has approximately a triangular shape.

Figure 3D:
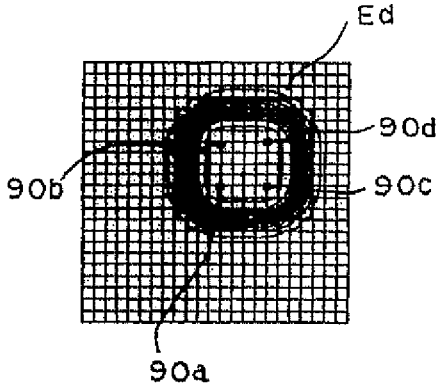

In FIG. 3D, there is shown electric potential distribution Ed in a case where an additional exposure pixel 90*d* is provided so as to be adjacent to the exposure pixel 90*b* in the main scanning direction in the configuration shown in FIG. 3C and the four exposure pixels of the exposure pixel 90*a*, the exposure pixel 90*b*, the exposure pixel 90*c*, and the exposure pixel 90*d* are turned on at the same time. In this case, the electric potential distribution Ed has a shape that surrounds the exposure pixels 90*a* to 90*d* disposed in the rectangular shape.

Thus, in the electric potential distribution of configurations shown in FIGS. 3A to 3D in the related art, since the distribution of electric potentials has a sharp shape but the shape of the distribution changes according to a gray-scale level, the density does not change in proportion to the number of pixels. As a result, the gradation control is difficult.

Figure 4A:
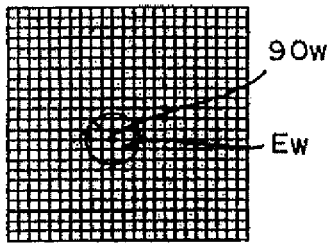
FIGS. 4A to 4D are explanatory views illustrating a line head according to an embodiment of the invention.
Figure 5:
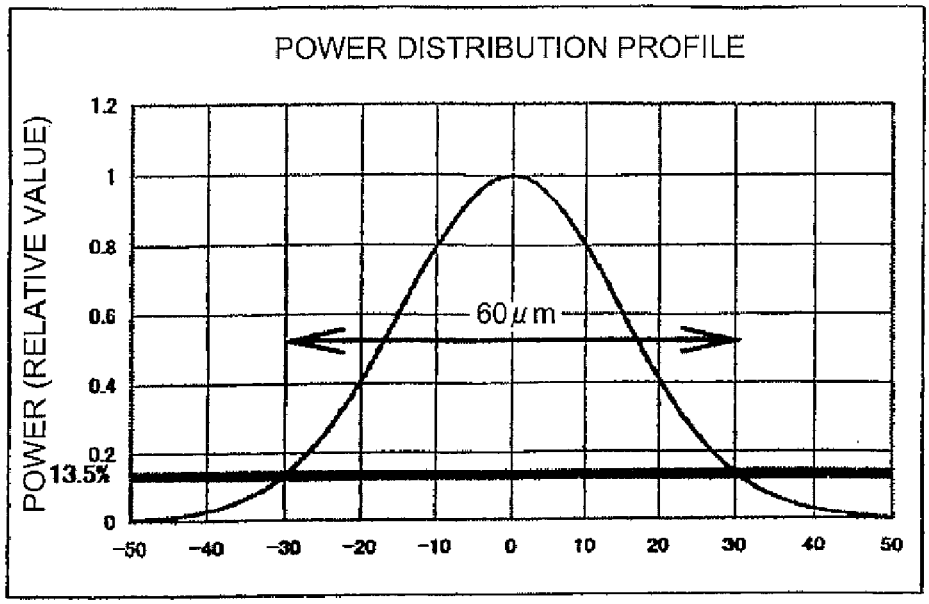
FIG. 5 is a characteristic view illustrating a line head according to an embodiment of the invention.
Figure 6:
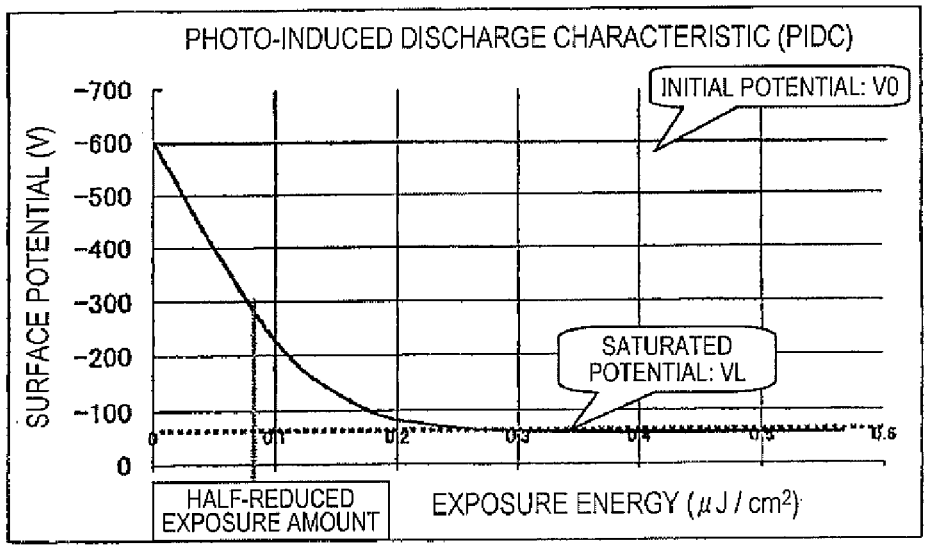
FIG. 6 is a characteristic view illustrating a line head according to an embodiment of the invention.

FIGS. 4A to 4D are explanatory views illustrating change of surface potential distribution as the number of exposure pixels that are turned on increases in the embodiment of the invention. In this example, the density of exposure pixels is set to 2400 dpi and the spot diameter is 60 μm. FIGS. 5 and 6 are characteristic views illustrating condition setting which are the requisite for the configurations of FIGS. 4A to 4D. FIG. 5 is a characteristic view illustrating power distribution according to a spot of a light source imaged on a photoconductor (image carrier).

When a spot imaged on a photoconductor has distribution of power (intensity) shown in FIG. 5, assuming that a peak is 1 and 'e' is natural log, $1/e^2=1/(2.72)2\cong0.135$. That is, the spot diameter of 60 μm indicates the width of a profile becoming 13.5% of a peak of power.

FIG. 6 is a characteristic view illustrating a photo-induced discharge characteristic (PIDC) of a photoconductor. A vertical axis indicates a surface potential (V) of a photoconductor and a horizontal axis indicates an exposure energy (μJ/cm$^2$). In FIG. 6, a surface potential of the photoconductor corresponding to an initial potential V0 is −600 V. An exposure energy corresponding to an amount (a surface potential is −300 V) of exposure reduced to half of the initial potential is 0.08 μJ/cm$^2$.

In addition, a state where a surface potential does not almost change with respect to an exposure energy, that is, the surface potential is saturated is expressed as an energy (saturated energy) when an overall surface of a photoconductor is exposed. In the example shown in FIG. 6, the saturated energy is 0.3 μJ/cm$^2$.

As described above in FIGS. 5 and 6, FIGS. 4A to 4D illustrate characteristics of surface potential distribution in the case when the spot diameter corresponding to $1/e^2\cong0.135$ is 60 μm, the half-reduced amount of exposure of a photoconductor is 0.08 μJ/cm$^2$, and the saturated energy is 0.3 μJ/cm$^2$. In FIG. 4A, potential distribution Ew when turning on a single exposure pixel 90*w* is formed almost in a circle. Even in FIGS. 4A to 4D, black dot indicates a central position of an exposure pixel.

Figure 4B:
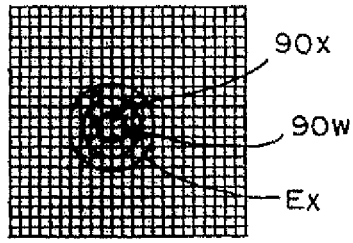

In FIG. 4B, there is shown electric potential distribution Ex in a case where an additional exposure pixel 90*x* is provided in the sub-scanning direction so as to be adjacent to the exposure pixel 90*w* described in FIG. 4A and the exposure pixel 90*x* and the exposure pixel 90*w* are turned on at the same time. In this case, the electric potential distribution Ex has approximately a circular shape. Here, equipotential lines of the potential distribution Ex are formed with distances of 50V.

Figure 4C:
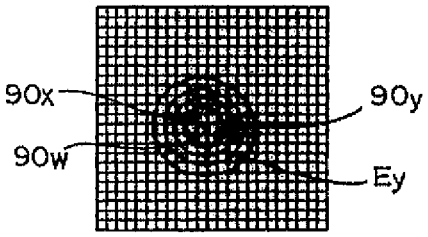

In FIG. 4C, there is shown electric potential distribution Ey in a case where an exposure pixel 90*y* is provided so as to be adjacent to the exposure pixel 90*w* in the main scanning direction in the configuration shown in FIG. 4B and three exposure pixels of the exposure pixel 90*w*, the exposure pixel 90*x*, and the exposure pixel 90*y* are turned on at the same time. Even in this case, the electric potential distribution Ey has an almost circular shape.

Figure 4D:
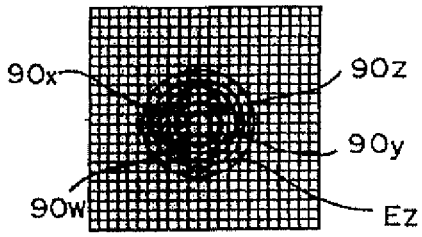

In FIG. 4D, there is shown electric potential distribution Ez in a case where an additional exposure pixel 90*z* is provided so as to be adjacent to the exposure pixel 90*x* in the main scanning direction in the configuration shown in FIG. 4C and the four exposure pixels of the exposure pixel 90*w*, the exposure pixel 90*x*, the exposure pixel 90*y*, and the exposure pixel 90*z* are turned on at the same time. In this case, the electric potential distribution Ez has an almost circular shape that surrounds the exposure pixels 90*w* to 90*z* disposed in the rectangular shape.

As explained in FIGS. 3A to 3D and 4A to 4D, it will be described why the shape of potential distribution in the embodiment of the invention is different from that in the related art. In the embodiment of the invention, the diameter (spot diameter) of each pixel that is exposed is 60 μm and the pixel pitch is about 10.6 μm, which is much smaller than the spot diameter. Accordingly, even if a plurality of exposure pixels are exposed by shifting the positions of the exposure pixels, the circular shape is almost maintained. On the other hand, in the related art, the diameter of a pixel is 20 μm that is small as compared with the embodiment of the invention. Accordingly, since an overlapping amount of pixels is small, the arrangement of pixels is reflected on the electric potential distribution.

Figure 7:
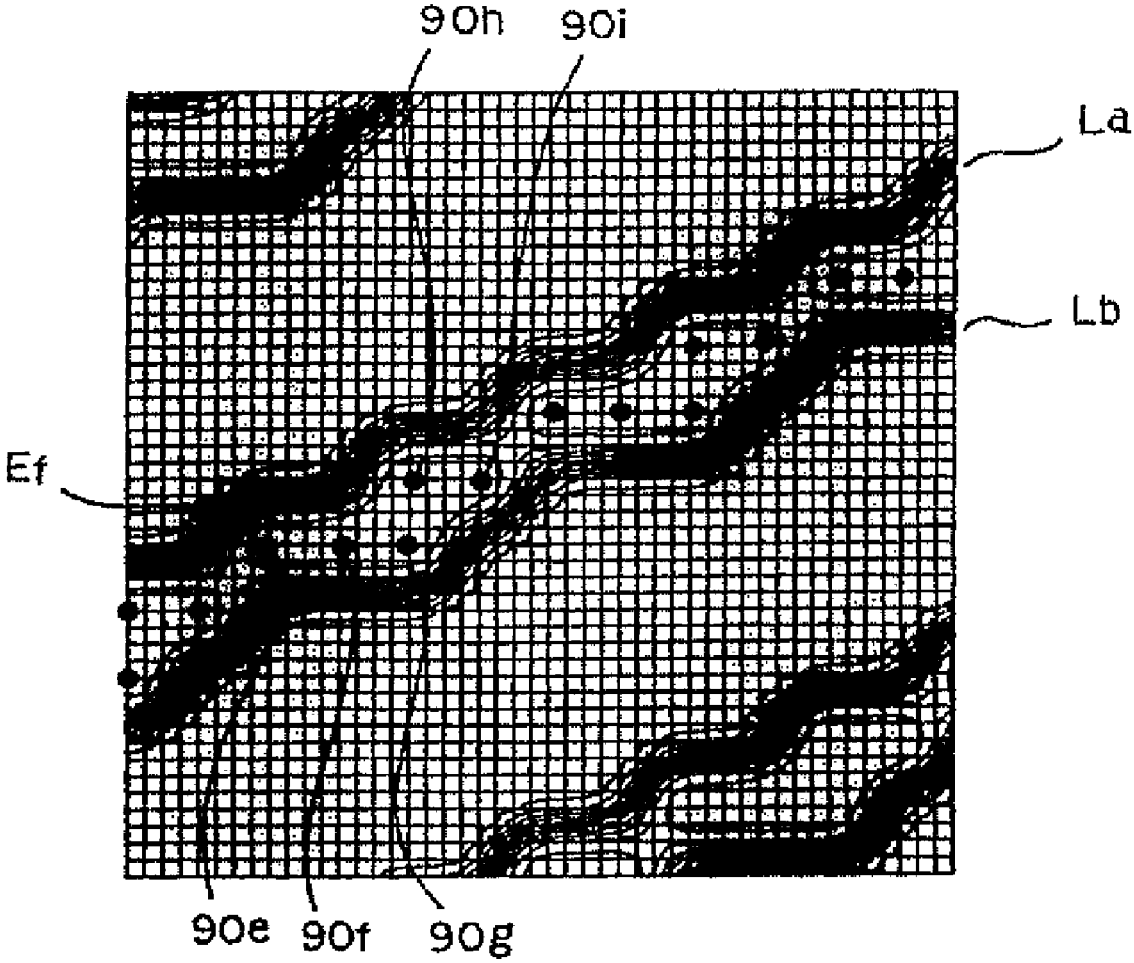
FIG. 7 is an explanatory view illustrating an example of the related art.

Next, a gray-scale screen displayed on the basis of a line width in the embodiment of the invention will be compared with that in the related art. FIG. 7 is an explanatory view illustrating a related art. In the example, the spot diameter is 20 μm. Reference numerals 90*e* to 90*i* denote exposure pixels, and reference numeral Ef denotes an electric potential distribution. In this case, line widths La and Lb change to move in a zigzag direction, such that density change increases.

Figure 8A:
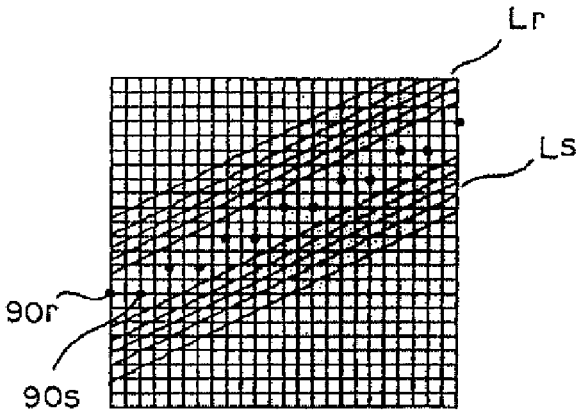
FIGS. 8A to 8C are explanatory views illustrating a line head according to an embodiment of the invention.
Figure 8C:
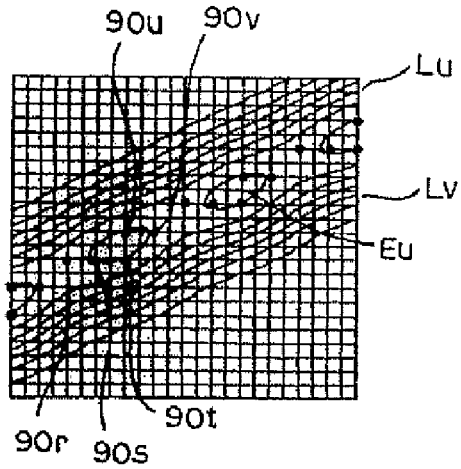
Figure 8B:
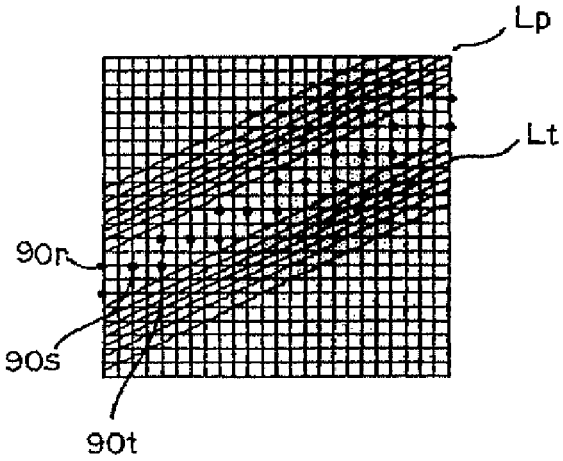

FIGS. 8A to 8C are explanatory views illustrating the embodiment of the invention. In examples shown in FIGS. 8A to 8C, the spot diameter is 60 μm and the same condition setting as in the examples described in the FIGS. 4A to 4D is made. FIG. 8A illustrates an example in which exposure pixels 90*r* and 90*s* are disposed in parallel in the main scanning direction and the exposure pixels 90*r* and 90*s* are shifted by two exposure pixels in the sub-scanning direction so as to be arranged in the oblique direction. At this time, lines Lr and Ls are formed as straight lines almost parallel to the arrangement of the exposure pixels, and a gray-scale characteristic expressed as a line width is satisfactory.

FIG. 8B illustrates an example in which three exposure pixels 90*r*, 90*s*, and 90*t* are disposed in parallel in the main scanning direction and the exposure pixels 90*r*, 90*s*, and 90*t* are shifted by two exposure pixels in the sub-scanning direction so as to be arranged in the oblique direction. At this time, lines Lp and Lt are formed as straight lines almost parallel to the arrangement of the exposure pixels, and a gray-scale characteristic expressed as a line width is satisfactory.

FIG. 8C illustrates an example in which three exposure pixels 90*r*, 90*s*, and 90*t* are disposed in parallel in the main scanning direction like FIG. 7 and two exposure pixels 90*u* and 90*v* are arranged at positions that are apart by two exposure pixels in the sub-scanning direction. In this case, electric potential distribution Eu is formed in an elliptical shape. Moreover, even though the lines Lu and Lv have slight irregularities, the lines Lu and Lv are formed to have smooth slopes which do not cause a trouble in practical use. As described above, in the embodiment of the invention, the effective characteristic is obtained even in the gray-scale screen on which the gradation is displayed on the basis of the line width, as compared with the related art.

Figure 9:
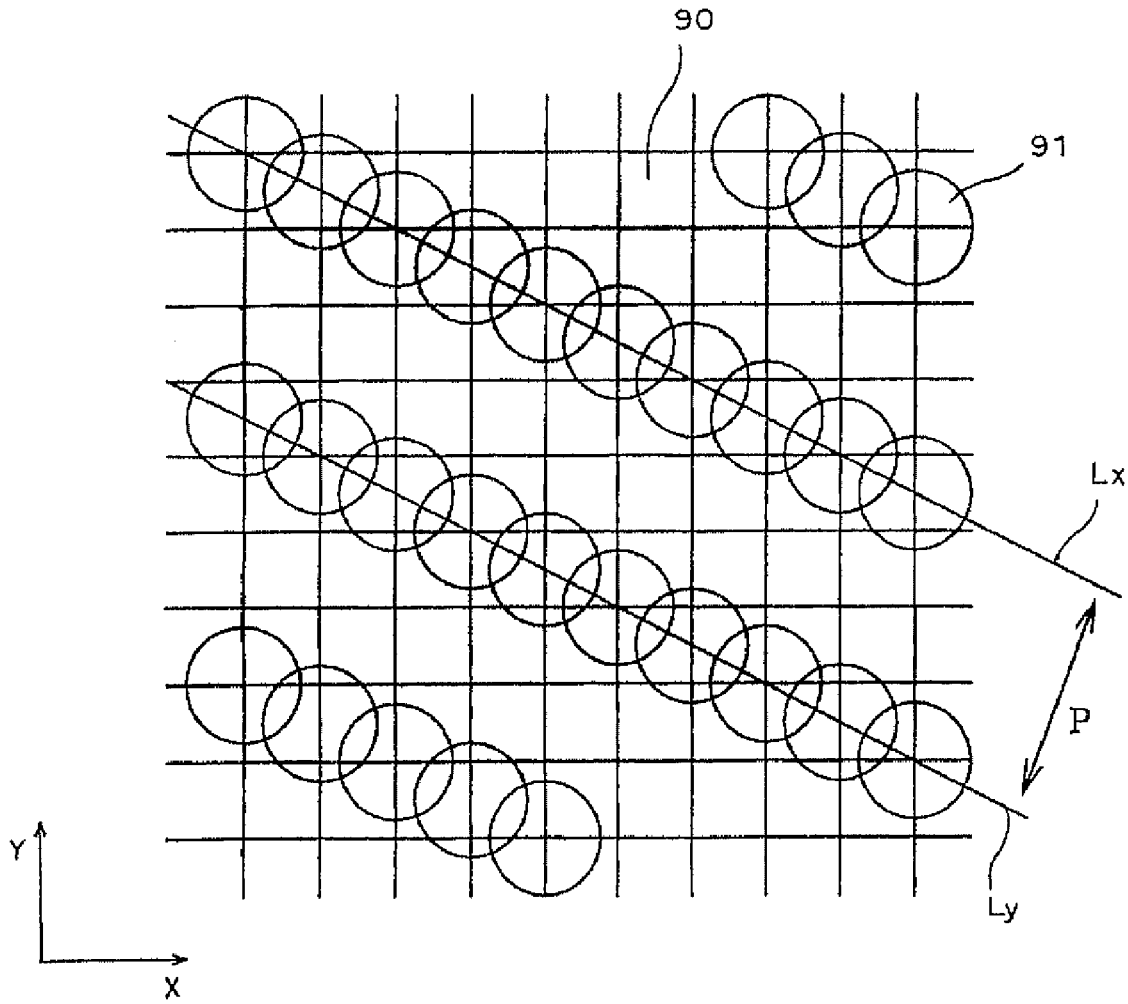
FIG. 9 is an explanatory view illustrating a line head according to an embodiment of the invention.
Figure 10:
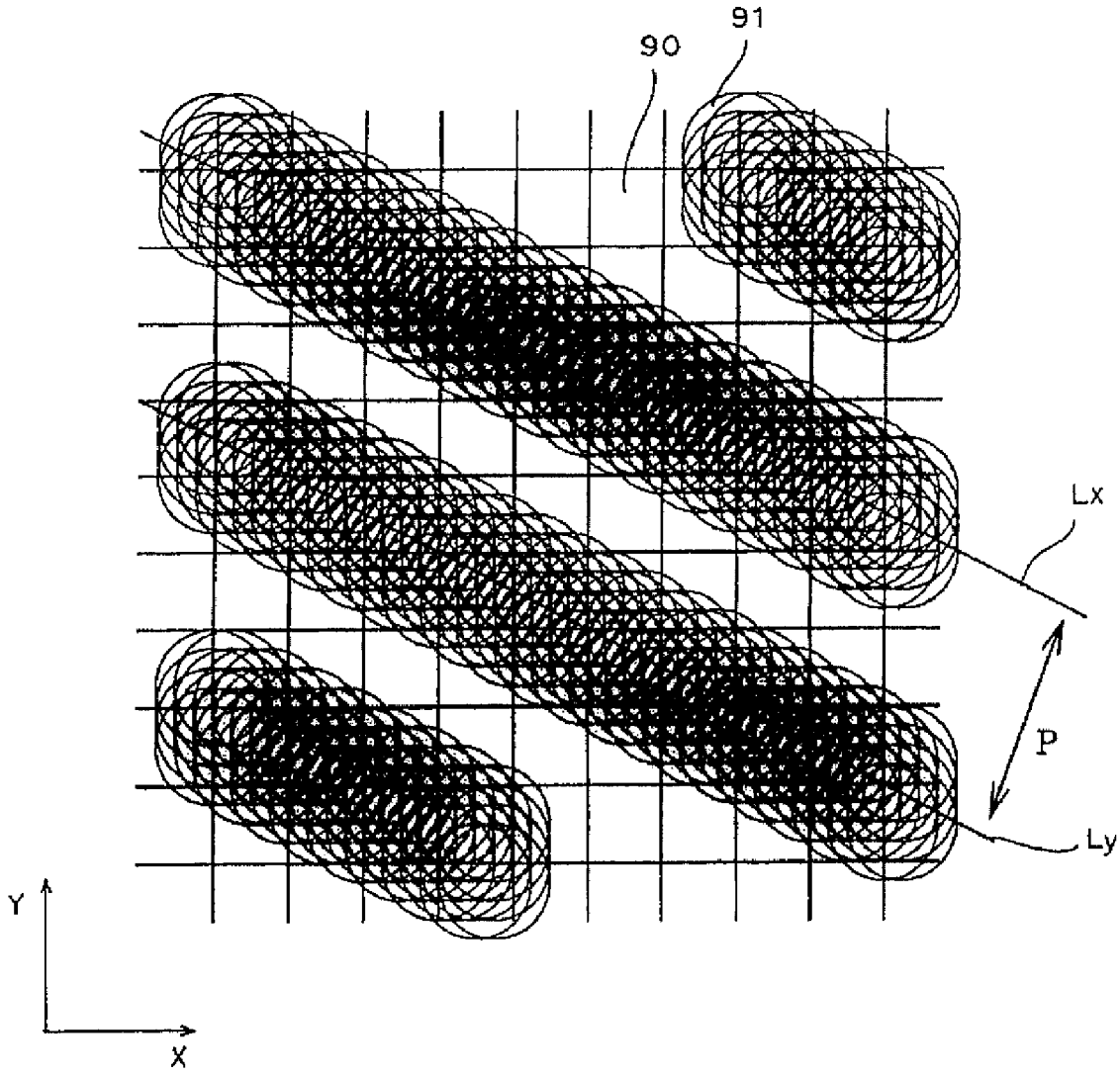
FIG. 10 is an explanatory view illustrating a line head according to an embodiment of the invention.

FIGS. 9 and 10 are explanatory views illustrating the embodiment of the invention where a gray-scale screen is used. FIG. 9 is an example of a screen on which a density gradation is expressed according to the thickness of an oblique line in the resolution of 600 dpi, for example. In FIG. 9, one square frame 90 represents a pixel of 600 dpi and has a size of 42.3 μm. Reference numeral 91 denotes a spot diameter and reference numerals Lx and Ly denote a screen. A line pitch P between the adjacent lines Lx and Ly is 3.13 pixels, that is, about 133 μm. The line pitch P of the screen is 192 LPI when the line pitch P is expressed by the use of the number of print lines (LPI: 1 inch=the line number of a screen per 25.4 mm). Even in a normal commercial printing, the screen line number of about 175 LPI is used. Moreover, in the example shown in FIG. 9, since exposure by a line head is considered, the position of a pixel can be controlled in the sub-scanning direction.

Figure 16:
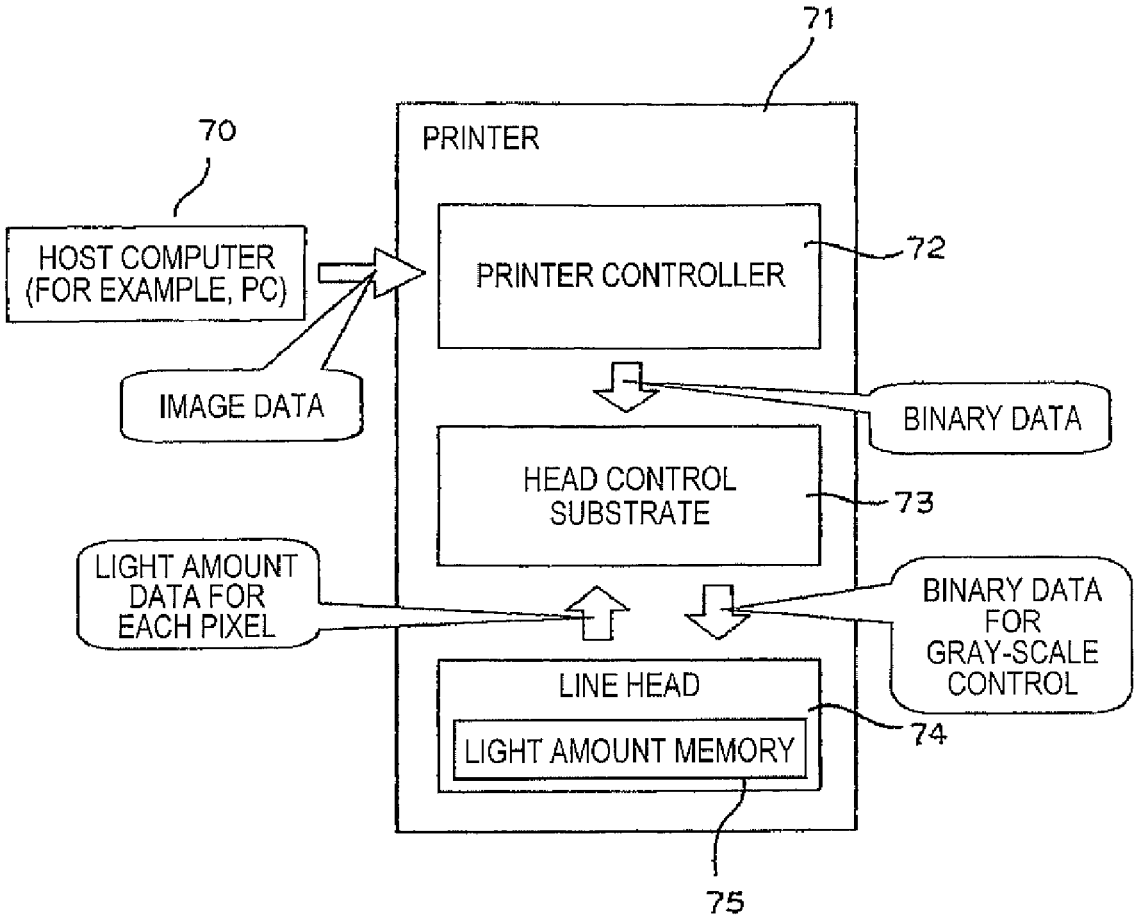
FIG. 16 is a block diagram illustrating an embodiment of the invention.

A process of displaying gradation with respect to an original gray-scale image by the use of the gray-scale screen is performed by a printer controller in FIG. 16. Converting an original image into data of a screen based on area gradation is to perform binarization, and a variety of techniques related to the binarization have been proposed. In the embodiment of the invention, the binarization technique is not explained in detail because the binarization technique is not related to the essence of the invention. For example, the binarization technique is disclosed in 'Photographic Industry, Special Supplement: imaging part 1, 'Photographic Industry Publishing Company, 1988.

If the line pitch P of a screen is reduced, the resolution increases but the distance between adjacent lines decreases, which causes interference the adjacent lines. If a level of a process of forming an image is not high, an effect due to non-uniformity of a process system occurs easily. As a result, interference levels are also different, and thus non-uniformity of images occurs easily. Thus, since it is difficult to make the line pitch P of the gray-scale screen small, the size of a spot of a light beam for exposure is preferably about a diameter by which the pitch of the gray-scale screen can be expressed.

FIG. 10 illustrates an example in which exposure pixels overlap in the pitch of 2400 dpi and with the spot diameter 91 having the same size as that in FIG. 9. As compared with FIG. 9, in FIG. 10, the profile of an oblique line is smooth but the width between oblique lines increases. Thus, in the embodiment of the invention, since the exposure images are overlapped with fine pitches therebetween without making the spot size 91 small, there is a characteristic that the width of a latent image of an exposed part increases. Hereinafter, the characteristic will be described in detail with reference to characteristic views shown in FIGS. 11 to 15.

Figure 11:
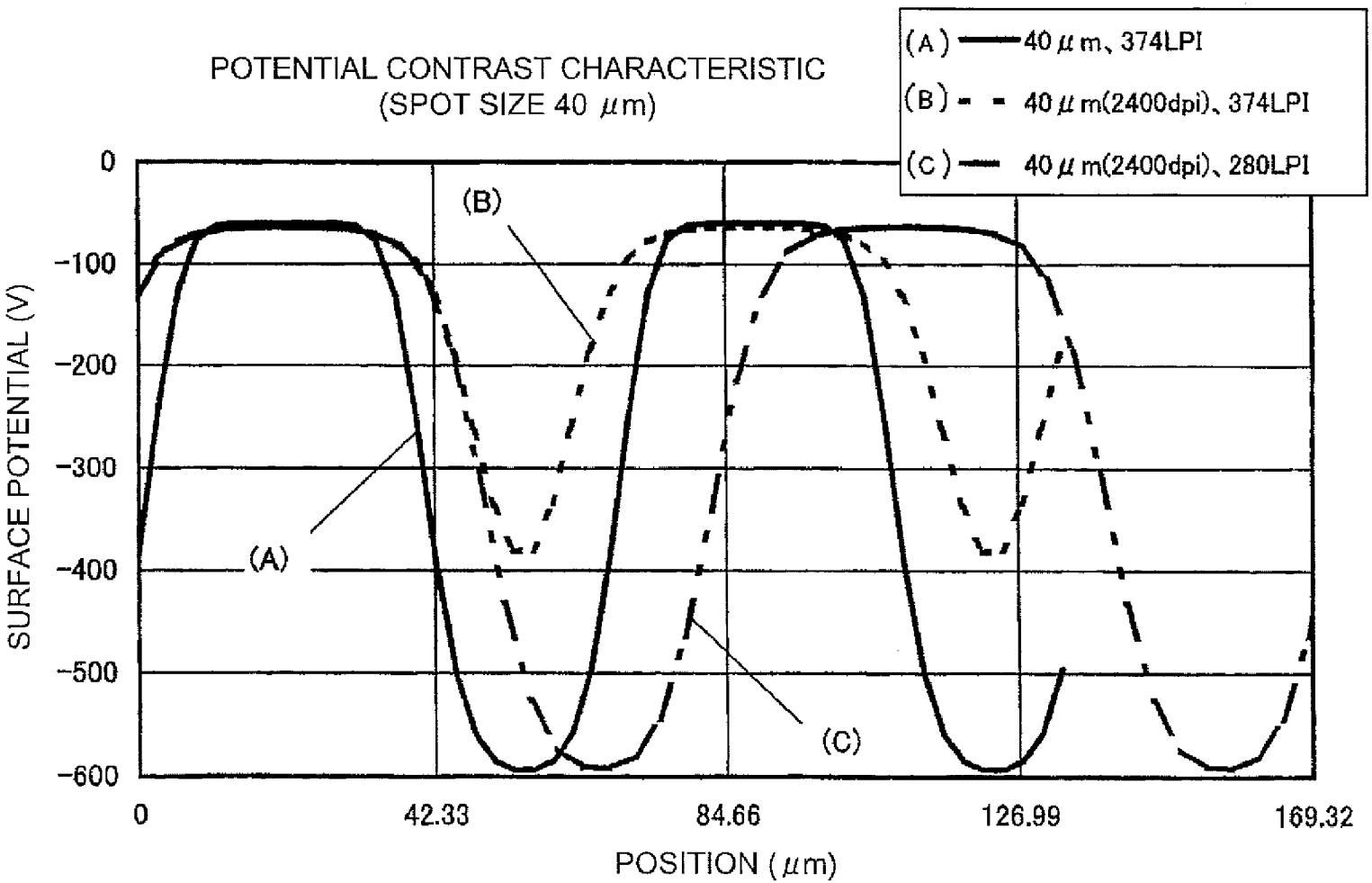
FIG. 11 is an explanatory view illustrating a line head according to an embodiment of the invention.

FIG. 11 is a view illustrating electric potential distribution (potential contrast characteristic) of a cross section in a direction perpendicular to a line when exposure is performed in the spot size of 40 μm. In the drawing, a photoconductor and an exposure condition thereof are the same as those in FIGS. 4A to 4D and 8A to 8C. A line (A) in FIG. 11 represents a case in which exposure is performed at a time without superimposition of pixels in a condition of a spot having a diameter of 40 μm and a pitch of 600 dpi in the related art. In FIG. 11, an initial charged potential is −600 V but an electric potential of an exposed part increases up to about −60 V. In addition, an electric potential of a non-exposed part increases up to only −590 V. On the other hand, in the embodiment of the invention, four of exposure pixels arranged in a pixel pitch of 2400 dpi are overlapped in the line width direction. Accordingly, as shown by a line in FIG. 11B, the width of an exposed part becomes large and the electric potential of a non-exposed part increases up to −380 V. That is, contrast between a white part and a black part is insufficient.

Moreover, such a condition means that portions of adjacent lines located at skirts of potential distribution interfere with each other. For this reason, the interference level changes due to a slight difference of light amount distribution of an imaged spot, which causes density unevenness. Therefore, as described in the embodiment of the invention, in the case when a plurality of exposure pixels are shifted to overlap each other, it is necessary to increase the screen pitch as much as the shifted amount. In this example, as shown by a line (C) in FIG. 11, by increasing the line pitch up to about 280 LPI, it is possible to secure the same potential difference as in the case where there is no overlapping with the pixel pitch of 600 dpi in the related art.

Figure 12:
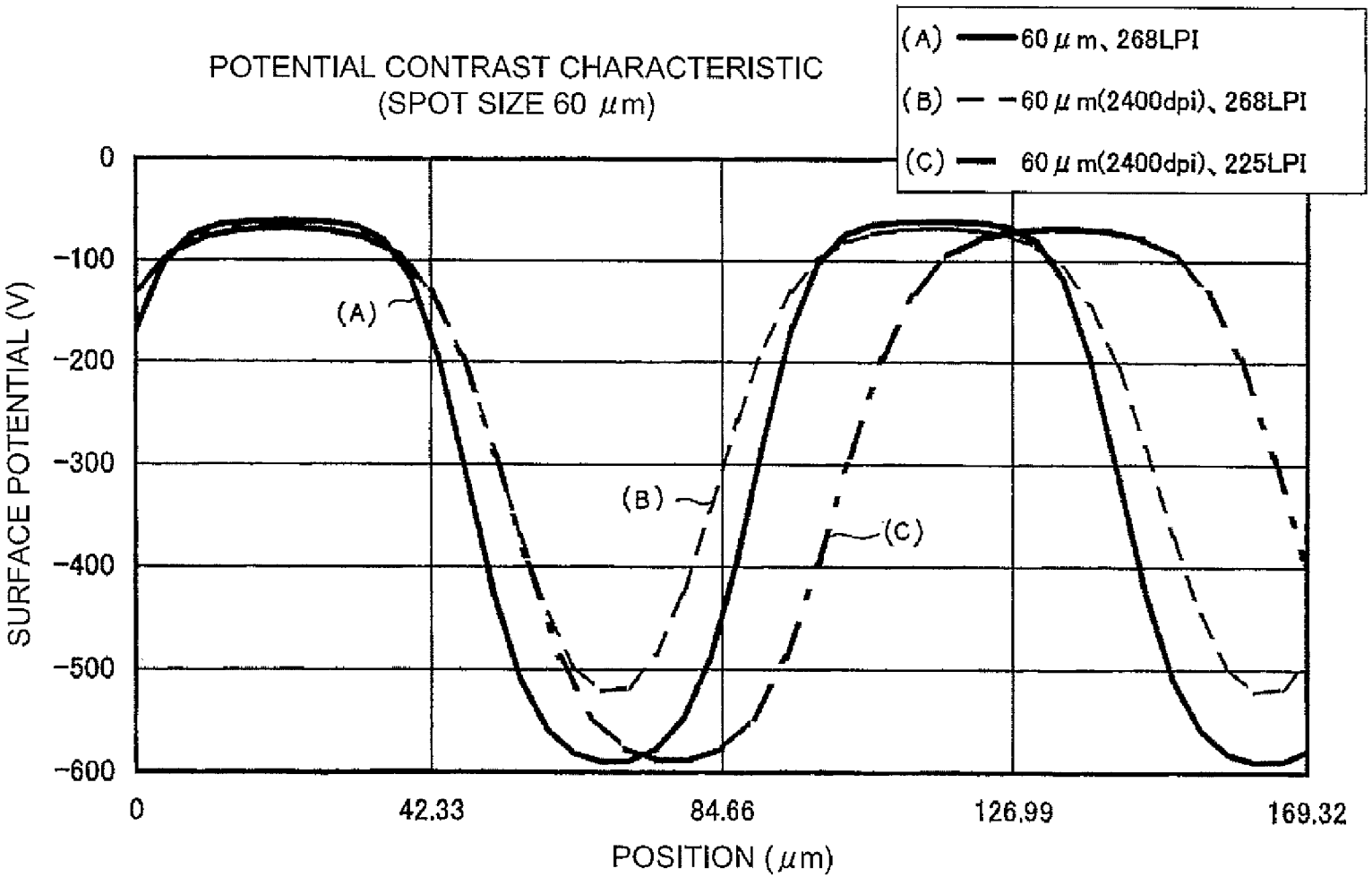
FIG. 12 is a characteristic view illustrating a line head according to an embodiment of the invention.
Figure 13:
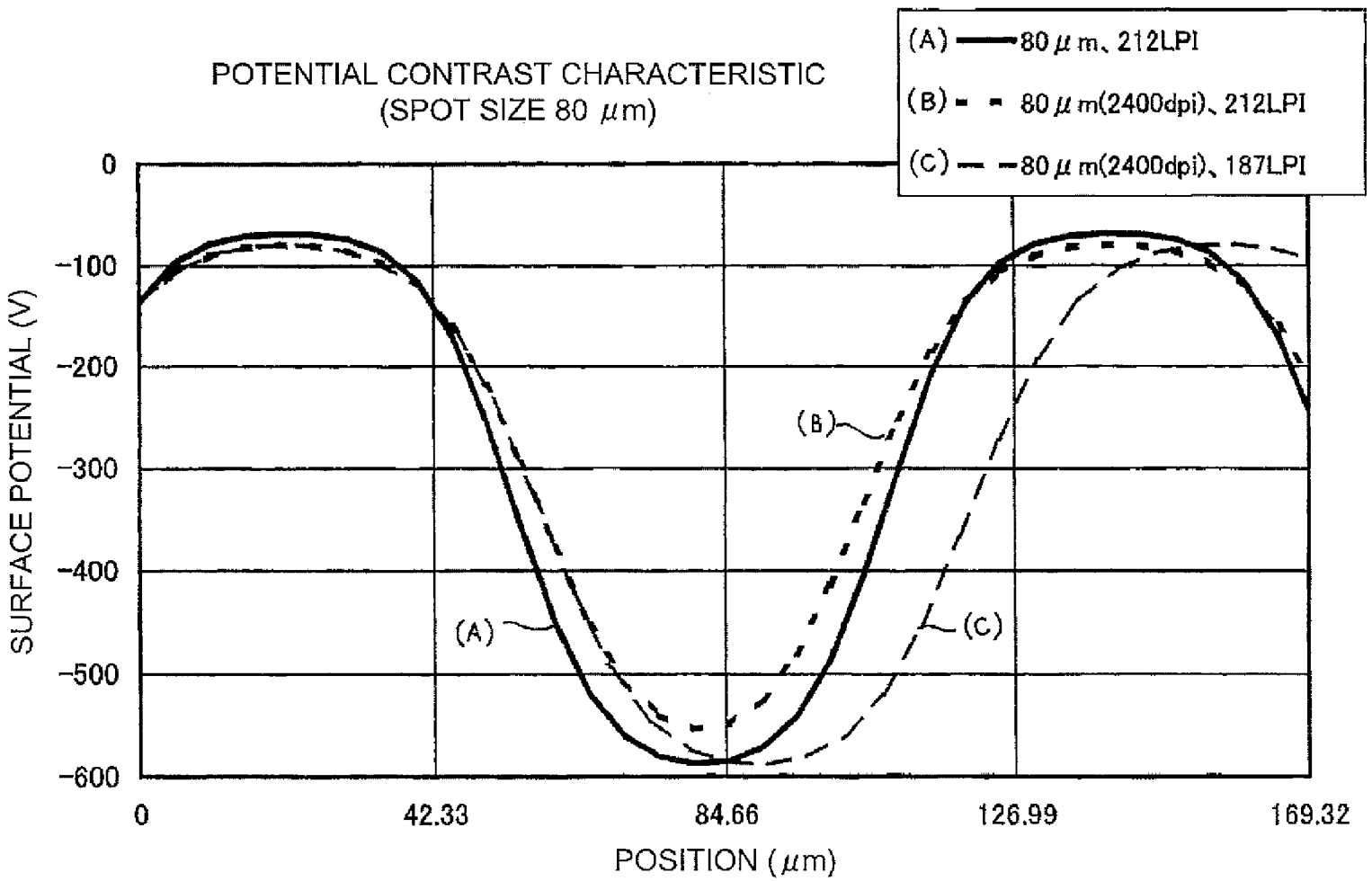
FIG. 13 is a characteristic view illustrating a line head according to an embodiment of the invention.

Similarly, FIG. 12 illustrates a potential contrast characteristic in a case when the spot size is 60 μm; and FIG. 13 illustrates a potential contrast characteristic in a case when the spot size is 80 μm. In these cases, the spot diameter and the line pitch of a reproducible screen can be summarized as characteristics related between the spot size and the line pitch shown in FIG. 14. In the above examples, four of pixels arranged in an exposure pixel pitch of 2400 dpi are overlapped in the line width direction, and the number of exposure pixels that overlap each other changes according to a gray-scale level to be displayed.

Thus, when the spot size is smaller than at least a pitch of a screen, the contrast of an image can be secured even if lines that form the screen are sufficiently exposed. In other words, in the embodiment of the invention, even in the case of a pitch between exposure pixels arranged in a relatively high density of 2400 dpi, sufficient gray-scale display can be made if the spot size is smaller than the pitch between line images that form the gray-scale screen. Accordingly, it is not necessary to make the spot size small more than needed, and requirements for an optical system that forms an image can also be alleviated.

In the embodiment described above, four exposure pixels are located in a line in the case of image formation with 2400 dpi where the invention is applied, as compared with a case in which pixels are formed in the pixel pitch of 600 dpi. Accordingly, light amount distribution or a latent image enlarges as much as three pitches of 10.6 μm, that is, 31.8 μm in 2400 dpi. In an example shown in FIG. 12, the latent image enlarges up to almost the value. On the other hand, in a case of FIG. 14 where an original spot size is large, an image is not enlarged much.

For example, in order to express a line corresponding to 192 LPI (133 μm pitch) shown in FIG. 12, it is preferable to realize the spot size of 80 μm. In addition, since the above description is made from the view point of reproducibility of a gray-scale screen, it is preferable to set the proper spot size small within the range of the invention in the case of put more importance on reproducibility of fine lines than the reproducibility of the gray-scale screen.

Figure 14:
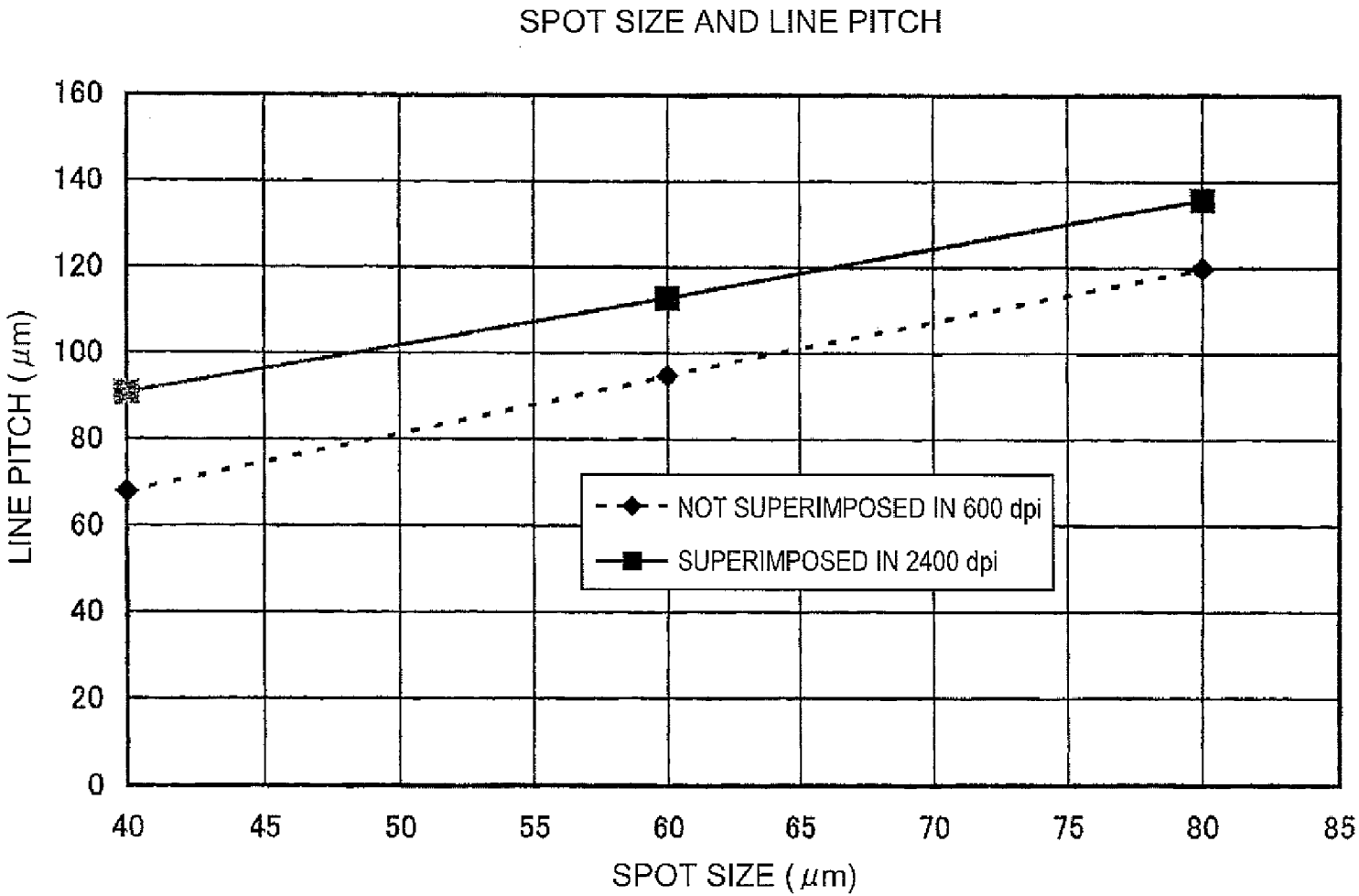
FIG. 14 is a characteristic view illustrating a line head according to an embodiment of the invention.

In the above description made with reference to FIGS. 12 to 14, an exposure time of one pixel in the case where there is no overlapping in the related art is sufficiently short as compared with a movement time of a photoconductor corresponding one pixel. In the case when the exposure time of one pixel is equal to one pixel movement time of the photoconductor, that is, all is turned on during one pixel period, the same electric potential distribution as in the overlapping exposure in the embodiment of the invention shown in FIGS. 12 to 14 is obtained in the sub-scanning direction. In the above embodiment, it has been described about a case of using a screen of lines that display the density gradation on the basis of the size of an oblique line. However, the same is true for a case of using a screen of dots that display the density gradation on the basis of an area of a halftone dot. In the case of the screen of dots, it is preferable to set the spot size having a diameter smaller than a minimum pitch between dots.

FIG. 16 is a block diagram schematically illustrating the configuration of a control unit according to the embodiment of the invention. Referring to FIG. 16, reference numeral 70 denotes a host computer, such as a personal computer (PC). The host computer 70 creates image data and transmits the created image data to a printer controller 72 provided in a control unit 71 of a printer. In addition to the printer controller 72, the control unit 71 of a printer includes a line head control substrate 73 and a control unit 74 of a line head. The control unit 74 of a line head includes a light amount memory 75.

The printer controller 72 creates binary data, which is digital data, on each exposure pixel on the basis of image data transmitted from the host computer 70 and then outputs the created binary data to the line head control substrate 73. The line head control substrate 73 is provided with a calculation unit. The calculation unit of the line head control substrate 73 creates binary data for gradation control on each exposure pixel on the basis of the light amount data for each pixel stored in the light amount memory 75 and the binary data input from the printer controller 72.

Figure 17:
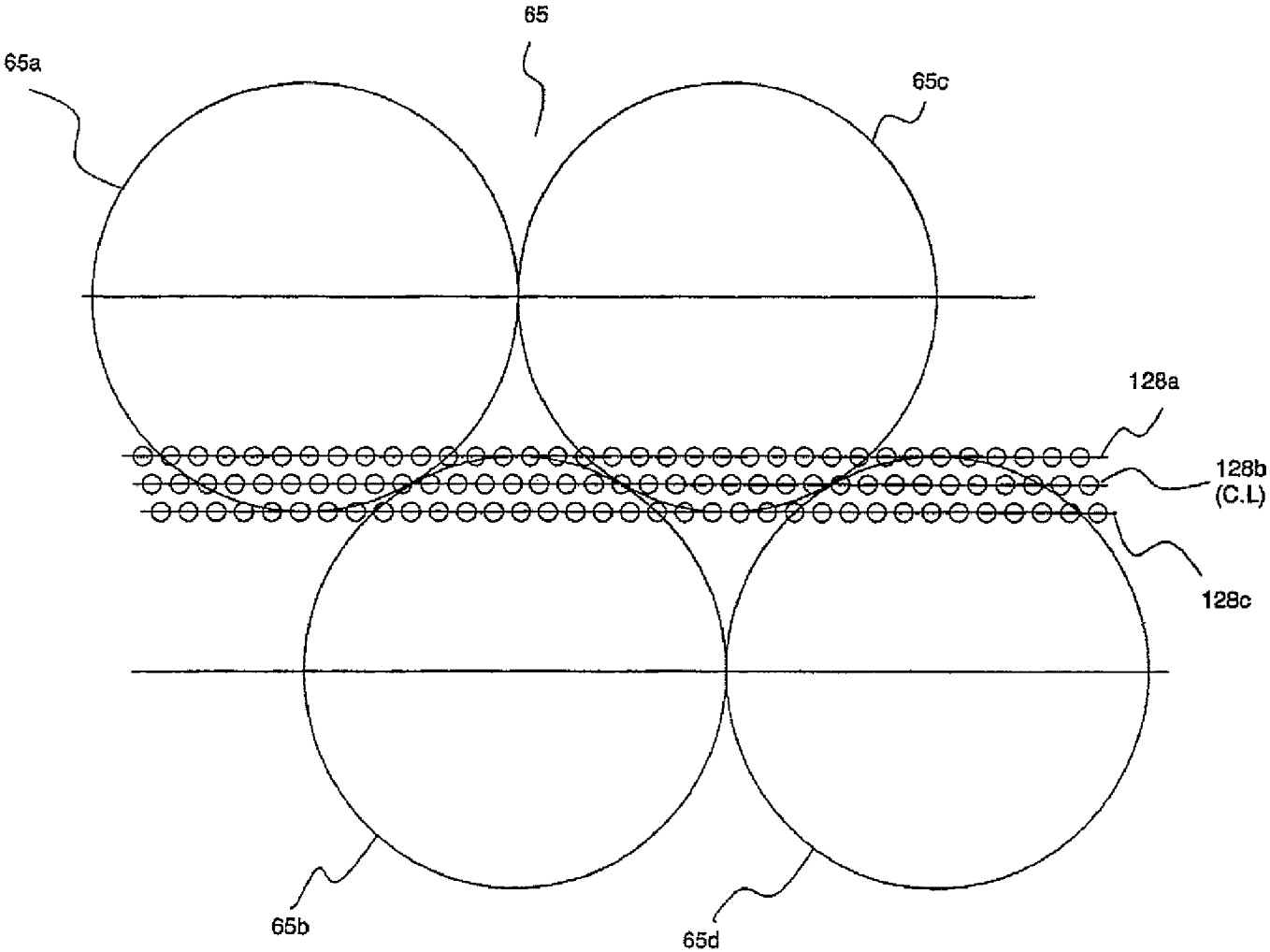
FIG. 17 is an explanatory view illustrating a line head according to an embodiment of the invention.
Figure 18:
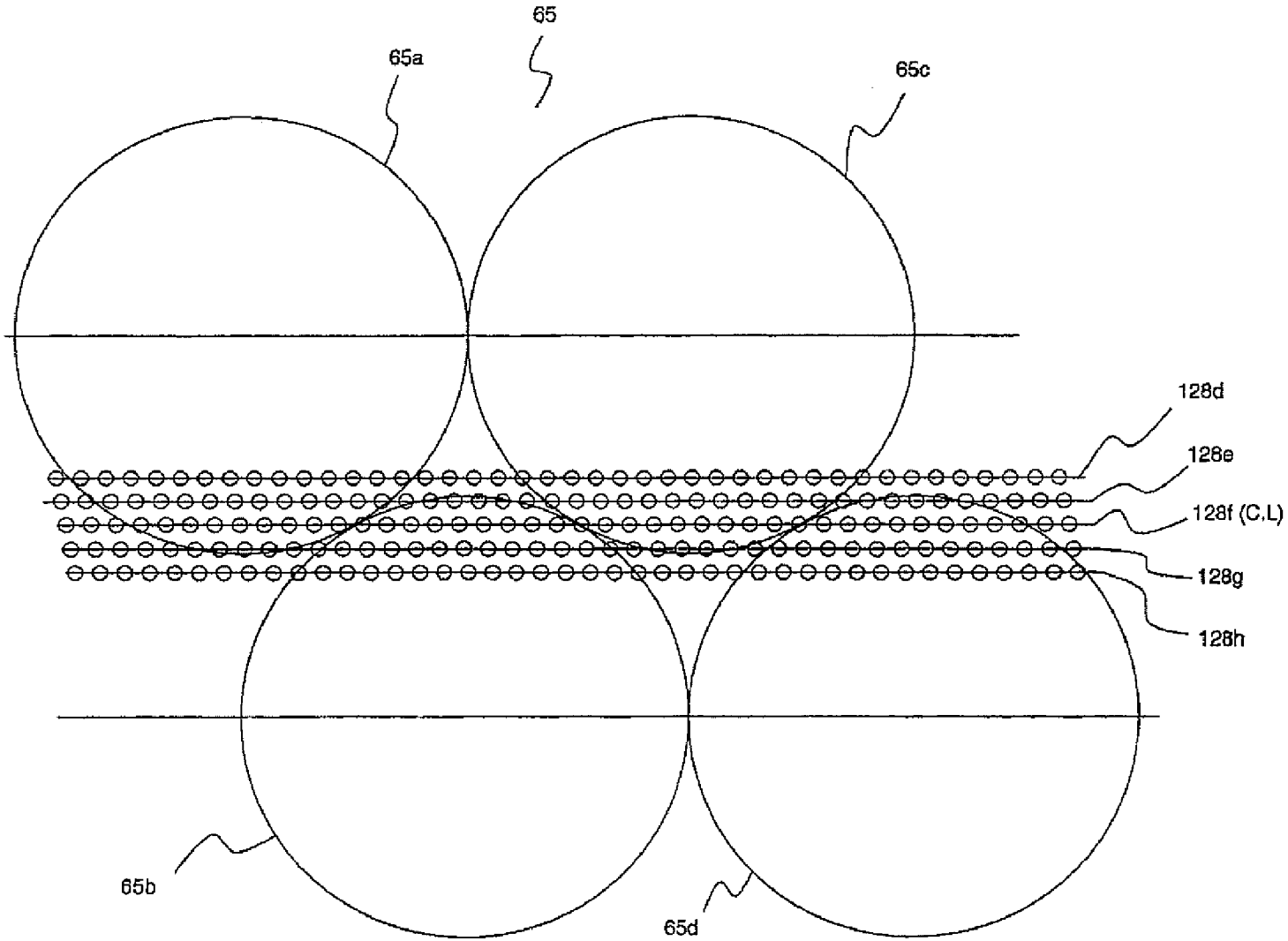
FIG. 18 is an explanatory view illustrating a line head according to an embodiment of the invention.

In the embodiment of the invention, a Selfoc lens array (simply referred to as 'SLA', which is trademark of Nippon Sheet Glass Co., Ltd.) serving as a refractive-index-distribution-type rod lens array is used in an optical imaging system. Thus, it is possible to form an imaged spot on an exposed surface with high precision by using the SLA in the optical imaging system. FIGS. 17 and 18 are explanatory views illustrating examples in which the SLA described above is used. In addition, the arrangement of a light source in FIGS. 17 and 18 corresponds to that in FIGS. 1A and 1B. Referring to FIG. 17, in the rod lens array 65, rod lenses 65*a* to 65*d* are zigzag disposed at two rows in the sub-scanning direction. Reference numerals 128*a* to 128*c* denote light-emitting element lines, and a plurality of light-emitting elements (exposure pixels) are arranged on each of the lines.

In this example, light-emitting element lines 128*a* to 128*c*, on which light-emitting elements having the same size are arranged, are disposed at positions symmetrical with respect to a center line (central axis) C.L of the rod lens array 65. That is, the light-emitting element lines 128*a* and 128*c* are disposed to be symmetrical to each other with respect to the central axis. Thus, in the example shown in FIG. 10, the three rows of light-emitting element line 128*a* to 128*c* are disposed in parallel in the sub-scanning direction.

Further, a distance between the light-emitting element lines 128*a* and 128*b* and a distance between the light-emitting element lines 128*b* and 128*c* are equal to each other. Accordingly, when exposing a plurality of pixels by the use of each of the light-emitting element lines, timing at which an image carrier moves and timing at which switching from a previously-emitted light-emitting element line to the next light-emitting element line occurs to emit light can be the same over the entire light-emitting element lines, the control can be simply performed. In the example shown in FIG. 17, a distance between the two lines (128*a* and 128*c*), which are farthest apart from each other in the sub-scanning direction, of the plurality of light-emitting element lines 128*a* to 128*c* is set to be smaller than a distance between centers of the plurality of rows of rod lenses of the rod lens array in the sub-scanning direction. Since the configuration described above is used, a plurality of light-emitting element lines are arranged within a range of the rod lens array in the sub-scanning direction. Accordingly, good imaging characteristics can be obtained.

Figure 15:
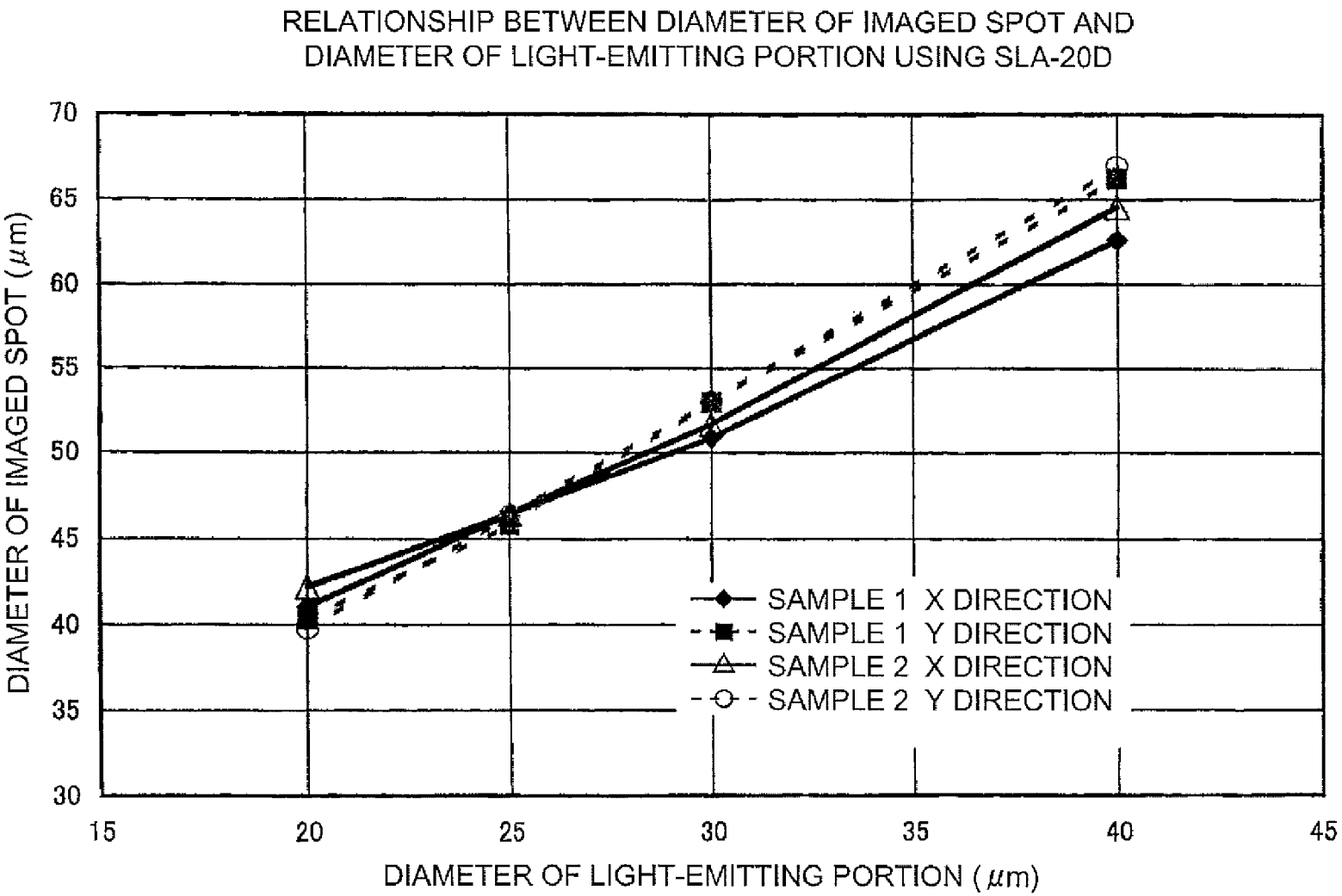
FIG. 15 is a characteristic view illustrating a line head according to an embodiment of the invention.

Next, an optical system used in the embodiment of the invention will be described. In the embodiment of the invention, it is suitable to use an organic EL material for a light-emitting portion, as will be described later. Since the light-emitting portion using the organic EL material is formed with coating, it is preferable to form the light-emitting portion in a circular shape such that coating unevenness does not occur within the light-emitting portion. In the optical imaging system of the line head according to the embodiment of the invention, the SLA can be used as described above. FIG. 15 is a characteristic view illustrating the relationship between an imaged spot diameter and a diameter of a light-emitting portion using a product number SLA-20D of Nippon Sheet Glass Co., Ltd. Even though the SLA is an un-magnifying optical system, the spot size is shown in a diameter of $1/e^2$ in FIG. 15, and accordingly, the spot size is larger than the diameter of a light-emitting portion. Assuming that the spot size is half of a peak value of light amount distribution, it can be seen that the spot size is almost equal to the diameter of a light-emitting portion.

Subsequently, the diameter of a light-emitting portion required to realize the spot size shown above can be obtained with reference to FIG. 15, For example, in order to obtain the spot size of 60 μm or less, it can be seen that the diameter of a light-emitting portion is preferably ϕ35 μm or less. Accordingly, since it is not possible to dispose a row of light-emitting portions in 2400 dpi, that is, a pitch of 10.6 μm, a plurality of rows of light-emitting portions are disposed as shown in FIGS. 1A, 1B, 17 and 18. In addition, since the relation shown in FIG. 15 indicates a state in which an image formed due to the SLA is smallest, that is, focused best, it is preferable to make the size of light-emitting portions smaller in consideration of deviation of focus in actuality. In the description in FIG. 1A or 1B, the spot size is set to be smaller than that in FIG. 15 in consideration of those described above.

FIG. 18 is an explanatory view related to another embodiment of the invention. In this example, five rows of light-emitting element lines 128*d* to 128*h* are disposed. In the example shown in FIG. 18, a distance between the two lines (128*d* and 128*h*), which are farthest apart from each other in the sub-scanning direction, of the plurality of light-emitting element lines 128*d* to 128*h* is set to be smaller than a distance between centers of two rows of rod lenses of a rod lens array in the sub-scanning direction. As shown in FIG. 18, in the embodiment of the invention, the light-emitting element lines are disposed at positions symmetrical to each other with respect to a central axis of the rod lens array. The light-emitting elements may be disposed in parallel in a two-dimensional manner or in a zigzag manner. In any cases, the light-emitting element lines can be disposed on the central axis of the rod lens array. In addition, the light-emitting element lines may be disposed to be apart from each other at the same distances or at different distances.

In the configuration shown in FIG. 17 where a two-row SLA is arranged in the sub-scanning direction, a satisfactory characteristic of imaging is obtained in the vicinity of a center of the two-row SLA. Furthermore, three or more rows of light-emitting element lines are arranged at positions within a range in the sub-scanning direction of the SLA. In this case, the width (range in the sub-scanning direction) of the three or more rows of light-emitting element lines is 100 μm or less.

However, in view of an aberration problem, although the SLA is an un-magnifying optical system, it is difficult to reproduce an image having the same size as a light source on an imaged surface. For example, even if the diameter of a light-emitting portion is 20 μm, the spot size is only about 60 μm as described above. Moreover, for example, even if a small imaged spot is obtained, a 'blur' of an electrostatic latent image due to movement of electric charges occurs in a two-layered photoconductor. However, since the diameter of a light-emitting portion is much larger than the pitch between light-emitting portions, it is difficult to arrange the light-emitting portions in one row. In addition, taking into consideration a gap, which allows wiring lines to pass between the light-emitting portions, and separation between the light-emitting portions, two or more rows of light-emitting portions should be disposed in a zigzag manner, which has been described above.

Further, in such a kind of image forming apparatus, the particle diameter of a toner that is developed cannot be set to be so small. Even in a process of attaching toners on an image carrier, scattering of toner or the like occurs, even though it depends on a developing method. In addition, scattering at the time of transferring, deformation of toner at the time of fixing, or the like only reduces the resolution of an image. Thus, an unnecessarily fine imaged spot causes focusing control of an optical system to be difficult. As a result, the focusing control of the optical system is easily affected due to an error of the optical system, and accordingly, there are few substantial merits. Then, in the embodiment of the invention, gradation is displayed by increasing the exposure pixel density without making the spot diameter small. For example, the gradation is displayed by setting the exposure pixel density in 2400 dpi or 4800 dpi which is larger than 600 dpi or 1200 dpi in the related art, that is, by setting the diameter of the imaged spot, which is obtained by imaging of each light source (exposure pixel) onto an exposed surface, larger than the pitch between exposure pixels.

Here, since the resolution in the sub-scanning direction can be controlled only by timing, the resolution in the sub-scanning direction may be higher than that in the main scanning direction. For example, it is assumed to arrange pixels in the main scanning direction and in the resolution of 1200 dpi and pixels in the sub-scanning direction and in the resolution of 4800 dpi. In this case, sufficient gradation of sixteen gray-scale levels can be obtained since sixteen (2×8=16) exposure pixels correspond, as compared with pixels in the resolution of 600 dpi.

In the embodiment of the invention, the spot size is set to be larger than the pixel pitch. Accordingly, it is difficult to obtain the resolution of an image corresponding to the pixel pitch. However, since the resolution for positioning an exposure pixel is high, the profile of an image can be made smooth.

Moreover, in the case of using an organic EL element, it is possible to set the diameter of a light-emitting portion not to be small in the embodiment of the invention, optical power of the light-emitting portion can be increased. For this reason, an organic EL material whose luminous efficiency is not high can also be used. In the embodiment of the invention, since exposure pixels are arranged in a density higher than that in a normal line head, the number of pixels noticeably increases. The invention may be applied to a line head using an LED, which has been used in the related art, as a light source. However, in this case, an LED array chip provided with a plurality of LEDs should be mounted on a substrate with high positioning precision and the number of bonding processes for connecting the chip with the substrate increases because the number of pixels is larger than that in a normal case.

In contrast, a case in which an organic EL element is used for a light source is suitable as the embodiment of the invention, since it is possible to form a plurality of pixels on a glass substrate at a time with high density and high precision. Further, in the embodiment of the invention, since it is sufficient to provide a driving circuit that only controls ON/OFF of each pixel without requiring a gradation control circuit and a light amount correction circuit for each pixel, the circuit configuration is simple. Accordingly, it becomes easy to form a driving circuit on a glass substrate, on which light-emitting portions are also formed, by the use of a thin film transistor. The thin film transistor may be formed of amorphous silicon, low-temperature polysilicon, high-temperature polysilicon, or an organic transistor.

Since the line head according to the embodiment of the invention has a very large number of pixels, it is also useful to divide pixels into some groups and to perform the driving in a time-division manner. Even in this case, since ON/OFF of each pixel is controlled in a binary manner as described above, the circuit configuration becomes extremely simple.

Hereinbefore, it has been described about an organic EL element serving as a light source (exposure pixel) in the embodiment of the invention. Alternatively, in the embodiment of the invention, it is possible to apply an LED, a fluorescent tube, various shutter arrays, or the like as a light source (exposure pixel), for example.

Even though the 'exposure pixel' in the embodiment of the invention can form an image by carrying out multiple exposures, the exposure pixel is an independent pixel driven by individual modulation information. Further, even though a plurality of rows of light-emitting element lines are formed in the sub-scanning direction even in the embodiment of the invention, a control is made such that latent images formed on a photoconductor are arranged in parallel in a row by changing ON timing according to a difference between positions in the sub-scanning direction and the speed of the photoconductor. That is, since the pixels have binary values but function as high-resolution pixels, the resolution of pixel positions the smoothness of a profile increase noticeably as compared with the related art.

Figure 19:
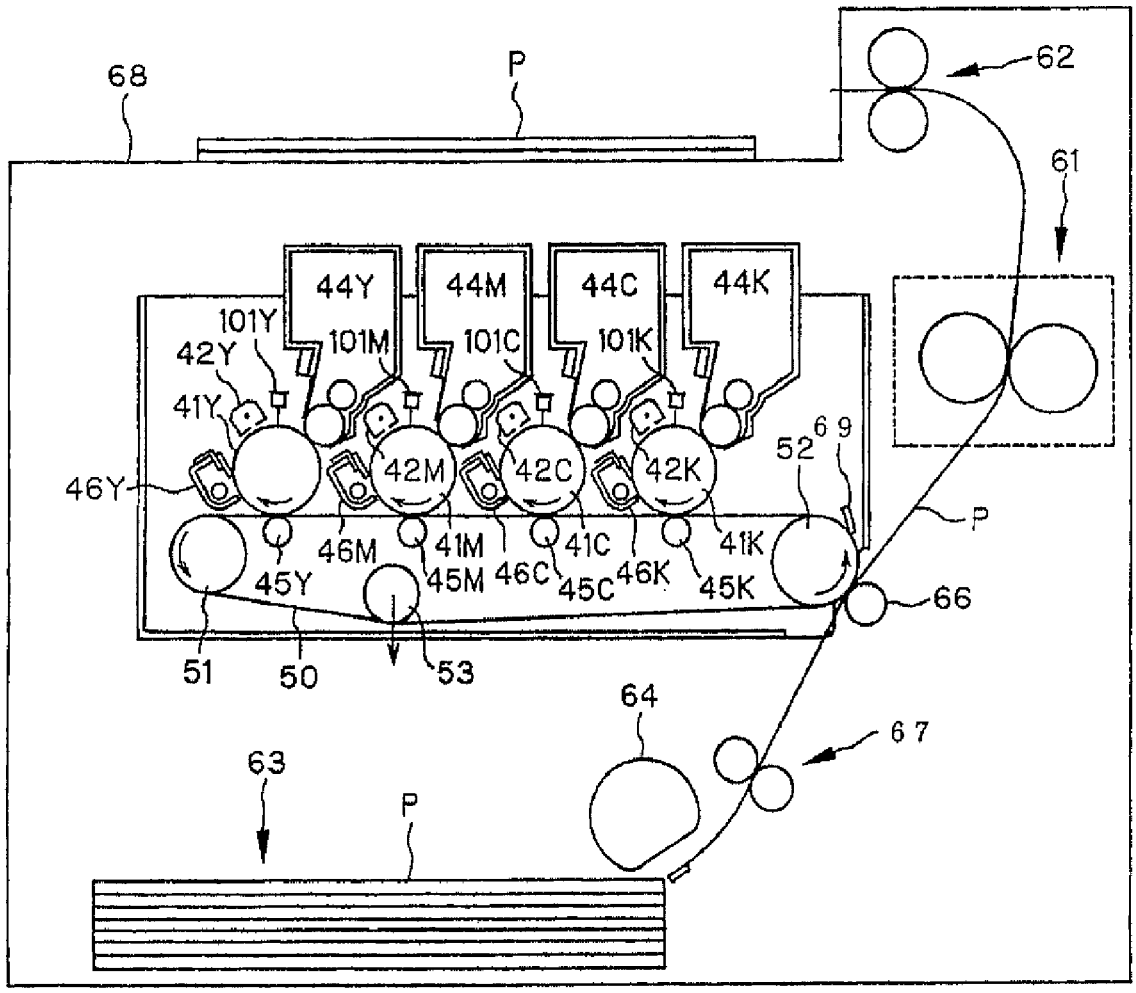
FIG. 19 is a longitudinal sectional side view illustrating an image forming apparatus according to an embodiment of the invention.

In the embodiment of the invention, there is provided a line head used in a tandem-type color printer (image forming apparatus) which exposes four photoconductors by the use of four lines, forms four-color images at the same time, and performs transferring onto one endless intermediate transfer belt (intermediate transfer medium). FIG. 19 is a longitudinal sectional side view illustrating an example of a tandem-type image forming apparatus that uses an organic EL element as a light-emitting element. In the image forming apparatus, four organic EL element array exposure heads 101K, 101C, 101M, and 101Y having the same configuration are respectively arranged at exposure positions of four corresponding photoconductor drums (image carriers) 41K, 41C, 41M, and 41Y having the same configuration. That is, the image forming apparatus is formed as a tandem-type image forming apparatus.

As shown in FIG. 19, the image forming apparatus includes a driving roller 51, a driven roller 52, a tension roller 53, and an intermediate transfer belt (intermediate transfer medium) 50 which is suspended by tension applied by the tension roller 53 and is driven to be rotated in the direction of the arrows shown in FIG. 19 (counterclockwise direction). The photoconductors 41K, 41C, 41M, and 41Y, serving as four image carriers, each having a photosensitive layer on an outer peripheral surface thereof, are arranged at predetermined intervals with respect to the intermediate transfer belt 50.

The letters K, C, M, and Y appended to the ends of the reference numerals stand for black, cyan, magenta, and yellow and indicate photoconductors for black, cyan, magenta, and yellow, respectively. The same is true for the other members. The photoconductor 41K, 41C, 41M, and 41Y are driven to rotate in the direction of the arrows shown in FIG. 19 (clockwise direction) in synchronization with the driving of the intermediate transfer belt 50. Charging units (corona chargers) 42 (K, C, M, Y) that uniformly charge the outer peripheral surfaces of the respective photoconductor 41 (K, C, M, Y) and the organic EL element array exposure heads (line heads) 101 (K, C, M, Y) of the embodiment of the invention described as above for sequentially line-scanning the outer peripheral surfaces charged uniformly by the charging units 42 (K, C, M, Y) in synchronization with rotations of the photoconductor 41 (K, C, M, Y) are provided on the periphery of the respective photoconductor 41 (K, C, M, Y).

Further, developing units 44 (K, C, M, Y) for applying toner, serving as a developing agent, onto electrostatic latent images formed by the organic EL element array exposure heads 101 (K, C, M, Y) in order to convert the images into visible images (toner images), primary transfer rollers 45 (K, C, M, Y), each serving as a transfer unit that sequentially transfers the toner images developed by the developing units 44 (K, C, M, Y) onto the intermediate transfer belt 50 that is to be primary-transferred, and cleaners 46 (K, C, M, Y) serving as cleaning units that remove toner remaining on the surfaces of the photoconductors 41K, 41C, 41M, and 41Y after the transfer are provided on the periphery of the respective photoconductors 41K, 41C, 41M, and 41Y.

Here, each of the organic EL element array exposure heads 101 (K, C, M, Y) is fixed such that the arrayed direction of the organic EL element array exposure heads 101 (K, C, M, Y) is parallel to buses of the respective photoconductor drums 41 (K, C, M, Y). In addition, the peak wavelengths of emission energy emitted from the organic EL element array exposure heads 101 (K, C, M, Y) are set to be approximately equal to the peak wavelengths of sensitivity of the respective photoconductors 41 (K, C, M, Y).

In the developing units 44 (K, C, M, Y), for example, a nonmagnetic-single-component toner is used as the developing agent. The single-component developing agent is transported to a developing roller by a feeding roller or the like, and the film thickness of the developing agent attached to the surface of the developing roller is restricted by a control blade. Then, the developing roller is brought into contact with or pressed against the respective photoconductors 41 (K, C, M, Y) to cause the developing agent to be adhered thereto depending on the electric potential levels of the respective photoconductors 41 (K, C, M, Y), and thus a toner image is developed.

The four toner images of black, cyan, magenta, and yellow generated by the four single-color toner image forming stations are primary-transferred sequentially onto the intermediate transfer belt 50 by a primary transfer bias applied to each primary transfer roller 45 (K, C, M, Y). Then, a full-color toner image generated by sequentially superimposing these single-color toner images on the intermediate transfer belt 50 is secondary-transferred onto a recording medium P, such as paper, by a secondary transfer roller 66. The secondary-transferred image is then fixed on the recording medium P by passing it through a pair of photographic fixing rollers 61, serving as photographic fixing units, and the recording medium P is finally ejected by a pair of paper discharging rollers 62 onto a paper discharging tray 68 provided at the top portion of the apparatus.

Furthermore, in FIG. 19, reference numeral 63 denotes a paper feeding cassette having a large number of recording media P stacked therein, and reference numeral 64 denotes a pick-up roller for feeding the recording media P from the feeding cassette 63 one by one. Reference numeral 67 denotes a pair of gate rollers for regulating the feeding timing of the recording medium P toward a secondary transfer portion of the secondary transfer roller 66, reference numeral 66 denotes a secondary transfer roller serving as a secondary transfer unit that forms a secondary transfer portion together with the intermediate transfer belt 50, and reference numeral 69 denotes a cleaning blade serving as a cleaning unit that removes toner remaining on the surface of the intermediate transfer belt 50 after the secondary transfer.

Figure 20:
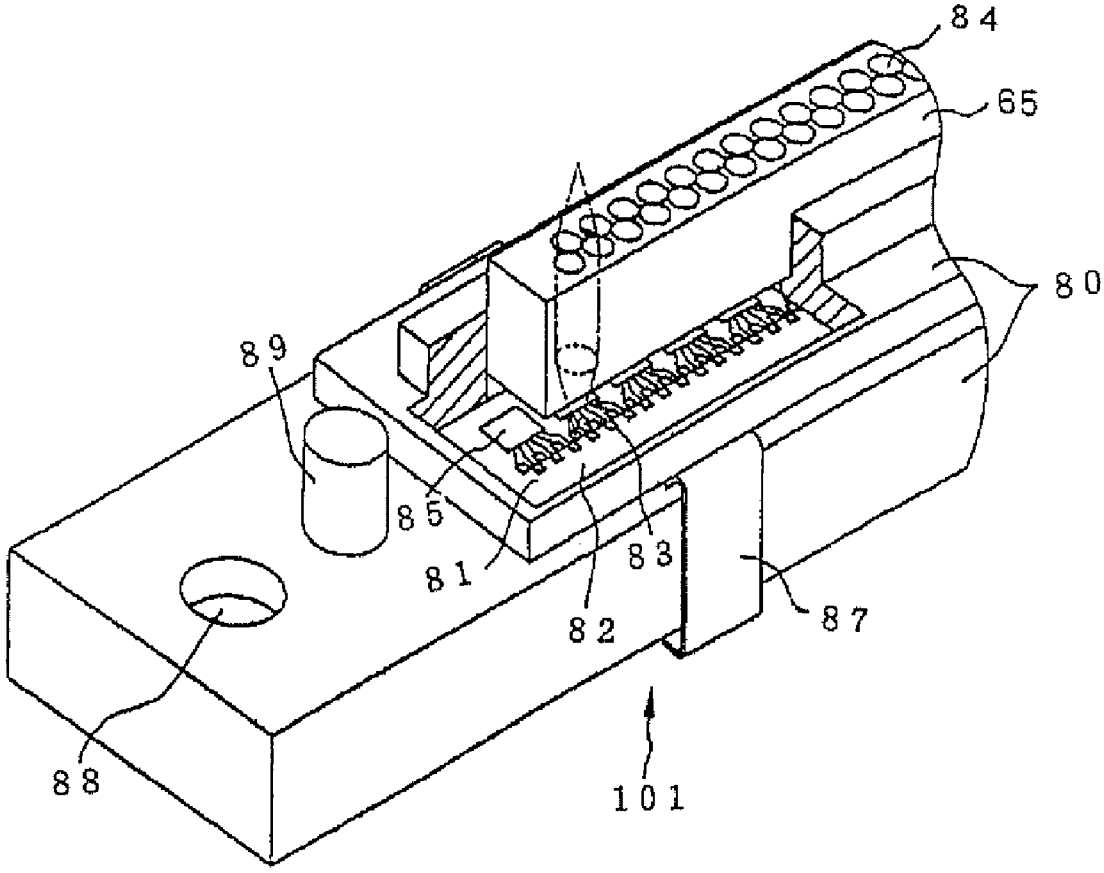
FIG. 20 is a perspective view illustrating a line head according to an embodiment of the invention.

FIG. 20 is an enlarged perspective view schematically illustrating the organic EL element array exposure head 101. In FIG. 20, an organic EL element array 81 is held in a long housing 80. Each of the organic EL element array exposure heads 101 is fixed at a predetermined position by fitting positioning pins 89, which are provided on both ends of the long housing 80, in opposite positioning holes on a casing and screwing and fixing lock screws into threaded holes of the casing through screw insertion holes 88 provided on the both ends of the long housing 80.

In the organic EL element array exposure head 101, light-emitting elements (organic EL elements) 83 of the organic EL element array 81 are mounted on a glass substrate 82 and the light-emitting elements 83 are driven by a driving circuit 85 formed on the same glass substrate 82. A refractive-index-distribution-type rod lens array (SLA) 65 forms an optical imaging system and includes refractive-index-distribution-type rod lens 84 arranged on a front surface of the light-emitting elements 83 in a staggered manner. As the rod lens array 65, the Selfoc lens array (simply referred to as 'SLA', which is trademark of Nippon Sheet Glass Co., Ltd.) described above is widely used.

A light beam emitted from the organic EL element array 81 is imaged on a scan surface as an erect and un-magnified image by the SLA 65. Thus, since the organic EL elements 83 are arranged on the glass substrate 82, illumination onto an image carrier can be performed without affecting a light amount of the light-emitting elements. In addition, since a static control on the organic EL elements is possible, a control system of a line head can be made simple. In the embodiment of the invention, in the tandem-type image forming apparatus shown in FIGS. 19 and 20, the gradation can be expressed with a simple mechanism.

Figure 21:
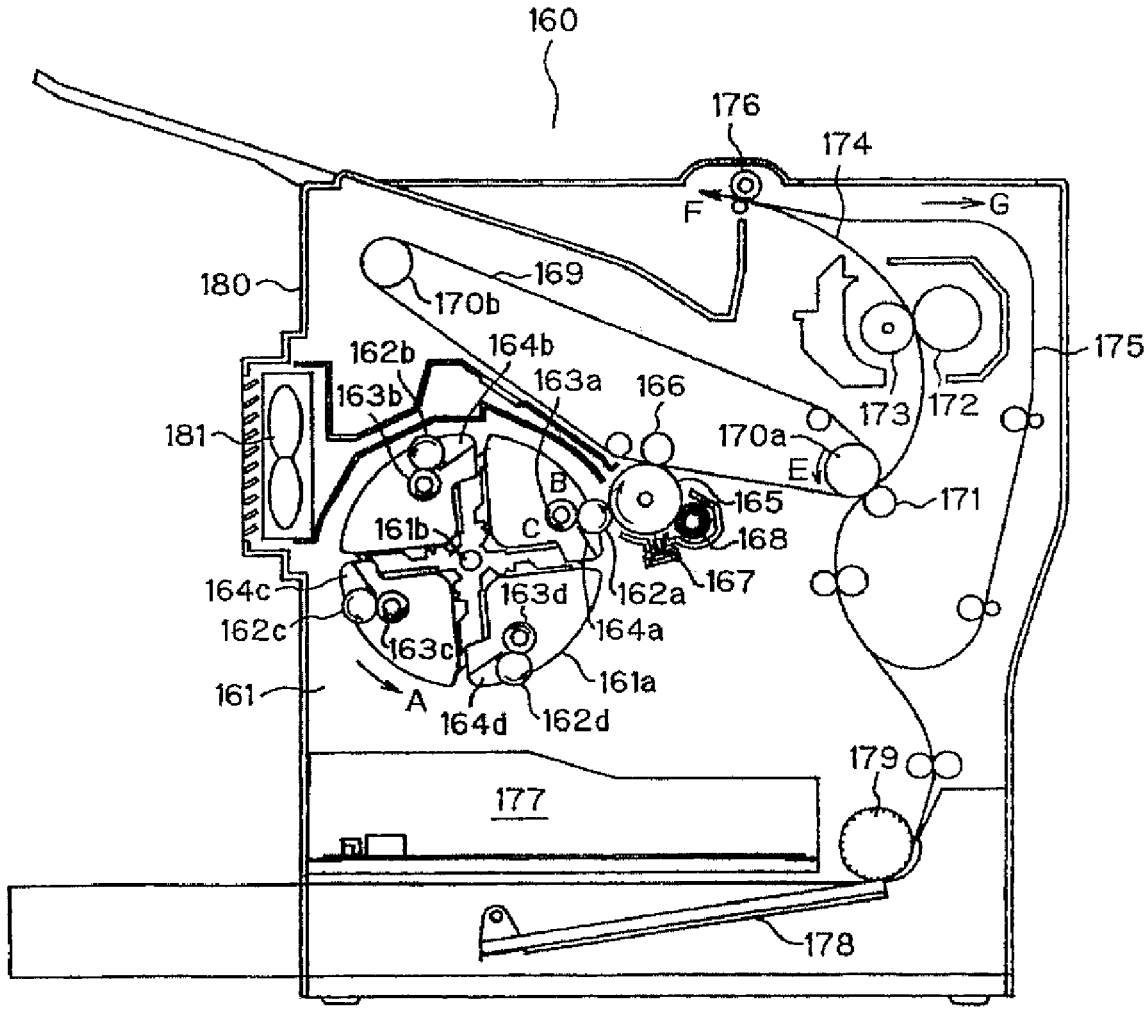
FIG. 21 is a longitudinal sectional side view illustrating an image forming apparatus according to another embodiment of the invention.

FIG. 21 is a longitudinal sectional side view illustrating another image forming apparatus. In FIG. 21, an image forming apparatus 160 includes, as main constituent members, a developing unit 161 which is of a rotary type, a photoconductor drum 165 serving as an image carrier, an image writer (line head) 167 provided with an organic EL element array, an intermediate transfer belt 169, a paper feeding path 174, a heating roller 172 of a fixing unit, and a paper feeding tray 178.

In the developing unit 161, a developing rotary 161*a* rotates in a direction indicated by the arrow A, with a shaft 161*b* as a center. The inside of the developing rotary 161*a* is divided into four parts, and image forming units corresponding to four colors of yellow (Y), cyan (C), magenta (M), and black (K) are provided in the four parts, respectively. Reference numerals 162*a* to 162*d* denote developing rollers that are disposed in the image forming units corresponding to four colors and rotate in the direction indicated by the arrow B, and reference numerals 163*a* to 163*d* denote toner supply rollers that rotate in the direction indicated by the arrow C, respectively. Numerals 164*a* through 164*d* denote regulating blades for regulating toner into a predetermined thickness, respectively.

Reference numeral 165 denotes a photoconductor drum serving as an image carrier as mentioned above, reference numeral 166 denotes a primary transfer member, reference numeral 168 denotes a charger, reference numeral 167 denotes an image writer having an organic EL array provided therein. The photoconductor drum 165 is driven by a driving motor (not shown), such as a stepping motor, in the direction indicated by the arrow D which is opposite to the direction of the developing roller 162*a*. The intermediate transfer belt 169 is stretched over between a driven roller 170*b* and a driving roller 170*a*. The driving roller 170*a* is connected to a driving motor of the photoconductor drum 165 so as to transmit driving power to the intermediate transfer belt. Due to the driving of the driving motor, the driving roller 170*a* of the intermediate transfer belt 169 rotates in the direction indicated by the arrow E which is opposite to the direction of the photoconductor drum 165.

On the paper feeding path 174, a plurality of feeding rollers and a pair of paper discharging rollers 176 are arranged in order to feed sheets of paper. A one-sided image (toner image) carried on the intermediate transfer belt 169 is transferred to one side of a sheet of paper at the position of a secondary transfer roller 171. The secondary transfer roller 171 is in contact with or apart from the intermediate transfer belt 169 by a clutch. When the clutch is ON, the secondary transfer roller 171 is brought in contact with the intermediate transfer belt 169, and thus the image is transferred onto the paper.

Thereafter, the paper having the transferred image thereon is subjected to a fixing process by a fixing unit having a fixing heater. The fixing unit includes a heating roller 172 and a pressing roller 173. After the fixing process, the paper is guided by the pair of paper discharging rollers 176 so as to move in the direction indicated by the arrow F. Under this state, when the pair of paper discharging rollers 176 rotates in the opposite direction, the paper sheet reverses the movement direction so as to move in the direction indicated by the arrow C on a dual-sided printing path 175. Reference numeral 177 denotes an electrical component box, reference numeral 178 denotes a paper feeding tray on which sheets of paper is placed, and reference numeral 179 denotes a pick-up roller provided at an outlet of the paper feeding tray 178. On the paper feeding path, for example, a low-speed brushless motor is used as a driving motor for driving feeding rollers. In addition, the intermediate transfer belt 169 uses a stepping motor because color correction or the like is required. These motors are controlled by signals from a control unit (not shown).

In the state shown in FIG. 21, an electrostatic latent image corresponding to yellow (Y) is formed on the photoconductor drum 165, and a yellow image is formed on the photoconductor drum 165 by applying a high voltage to the developing roller 162*a*. As both yellow images for back and front sides are completely carried onto the intermediate transfer belt 169, the developing rotary 161*a* rotates by 90° in the direction indicated by the arrow A. The intermediate transfer belt 169 makes one turn to return to the position of the photoconductor drum 165. Then, double-sided cyan (C) images are formed on the photoconductor drum 165, and the images are carried on the intermediate transfer belt 169 such that the images are superimposed on the yellow images carried on the intermediate transfer belt 169. Then, in the same manner as described above, rotation of the developing rotary 161*a* by 90° and one rotation of the intermediate transfer belt 169 after images are carried thereon are repeated.

In order to carry four-color images, the intermediate transfer belt 169 makes four turns and then the rotation position thereof is controlled such that the images are transferred to paper at the position of the secondary transfer roller 171. The paper fed from the paper feeding tray 178 is fed through the feeding path 174 and the color image is transferred onto one side of the paper at the position of the secondary transfer roller 171. The paper with the transferred image on one side thereof is reversed by the pair of paper discharging rollers 176 as described above and waits at the feeding path. Then, the paper is fed to the position of the secondary transfer roller 171 at proper timing, such that the color image is transferred to the other side of the paper. A housing 180 is provided with an exhaust fan 181. In the embodiment of the invention, in the rotary image forming apparatus shown in FIG. 21, the gradation can be expressed with a simple mechanism.

Although the line head and the image forming apparatus using the same according to the embodiments of the invention have been described based on the examples, the invention is not limited to the embodiments but various modifications can be made.

What is claimed is:

1. A line head comprising:

light-emitting element lines formed by arranging a plurality of light sources in a line shape in a main scanning direction, wherein each of the light sources is turned on/off corresponding to image data, light beams emitted from the light sources pass through a lens array to form imaged spots on an exposed surface, the imaged spots generated by making the light beams emitted from the plurality of light sources imaged on the exposed surface are shifted by inches in the main scanning direction or a sub-scanning direction so as to overlap each other, thereby forming images, a gray-scale image of the images has a screen structure displayed on the basis of an area of dots or lines having a predetermined pitch, a diameter of each of the imaged spots formed on the exposed surface is set to be larger than a pitch between pixels and smaller than a pitch between lines or dots forming the screen, and gradation of an image is displayed by a combination of binary states of ON/OFF of each of the light sources.

2. The line head according to claim 1, wherein the light-emitting element lines are arranged in the sub-scanning direction in the form of three or more rows of plural lines such that positions of the light-emitting element lines in the main scanning direction are different from each other.

3. The line head according to claim 2, wherein the lens array is a refractive-index-distribution-type rod lens array having a plurality of rows of rod lenses arranged in the sub-scanning direction.

4. The line head according to claim 3, wherein a distance between two of the plurality of light-emitting element lines farthest apart from each other in the sub-scanning direction is smaller than a distance between centers of two of the plurality of rows of rod lenses of the rod lens array that are farthest apart from each other in the sub-scanning direction.

5. The line head according to claim 1, wherein gray-scale display of an image using the plurality of light sources is a process on a gray-scale screen on which gradation is displayed on the basis of a line width.

6. The line head according to claim 5, wherein each of the light sources is an organic EL element.

7. The line head according to claim 6, wherein each of the light sources is formed on a single glass substrate.

8. The line head according to claim 7, wherein the light sources and thin film transistors for driving the light sources are formed on the single glass substrate.

9. An image forming apparatus comprising:

at least two or more image forming stations each having image forming units arranged therein, the image forming units including a charging unit provided on a periphery of an image carrier, the line head according to claim 1, a developing unit, and a transfer unit, wherein tandem-type image formation is performed by making a transfer medium pass through the stations.

10. An image forming apparatus comprising:

an image carrier configured to be able to carry an electrostatic latent image thereon;

a rotary developing unit; and the line head according to claim 1, wherein the rotary developing unit carries toners contained in a plurality of toner cartridges on a surface thereof, rotates in a predetermined rotation direction to sequentially transport different-colored toners to a position opposite to the image carrier, and applies a developing bias between the image carrier and the rotary developing unit in order to move the toners from the rotary developing unit to the image carrier, such that the electrostatic latent image is developed to form a toner image.

11. The image forming apparatus according to claim 10, further comprising:

an intermediate transfer member.

* * * * *